US007576278B2

(12) United States Patent
Urata

(10) Patent No.: US 7,576,278 B2
(45) Date of Patent: Aug. 18, 2009

(54) SONG SEARCH SYSTEM AND SONG SEARCH METHOD

(75) Inventor: Shigefumi Urata, Yaita (JP)

(73) Assignee: Sharp Kabushiki Kaisha, Osaka-shi (JP)

( * ) Notice: Subject to any disclaimer, the term of this patent is extended or adjusted under 35 U.S.C. 154(b) by 630 days.

(21) Appl. No.: 10/980,294

(22) Filed: Nov. 4, 2004

(65) Prior Publication Data

US 2005/0092161 A1 May 5, 2005

(30) Foreign Application Priority Data

Nov. 5, 2003 (JP) ..... 2003-376216
Nov. 5, 2003 (JP) ..... 2003-376217
Apr. 15, 2004 (JP) ..... 2004-120862

(51) Int. Cl.
*G10H 1/00* (2006.01)

(52) U.S. Cl. ..... 84/600; 700/94; 707/104.1

(58) Field of Classification Search ..... 84/600–609, 84/615; 700/94; 704/94; 707/104.1
See application file for complete search history.

(56) References Cited

U.S. PATENT DOCUMENTS 6,539,395 B1 * 3/2003 Gjerdingen et al. ..... 707/102
7,279,629 B2 * 10/2007 Hinman et al. ..... 84/615
2002/0002899 A1 * 1/2002 Gjerdingen et al. ..... 84/667
2002/0037083 A1 * 3/2002 Weare et al. ..... 381/58
2002/0087565 A1 * 7/2002 Hoekman et al. ..... 707/100
2002/0130898 A1 * 9/2002 Ogawa et al. ..... 345/727
2002/0181711 A1 * 12/2002 Logan et al. ..... 381/1
2003/0037036 A1 * 2/2003 Weare ..... 707/1
2003/0045953 A1 * 3/2003 Weare ..... 700/94
2003/0045954 A1 * 3/2003 Weare et al. ..... 700/94
2003/0221541 A1 * 12/2003 Platt ..... 84/609
2004/0060426 A1 * 4/2004 Weare et al. ..... 84/668
2005/0038819 A1 * 2/2005 Hicken et al. ..... 707/104.1
2005/0092161 A1 * 5/2005 Urata ..... 84/616
2005/0092165 A1 * 5/2005 Weare et al. ..... 84/668
2005/0120868 A1 * 6/2005 Hinman et al. ..... 84/615

(Continued)

FOREIGN PATENT DOCUMENTS

EP 1 244 093 A2 9/2002

(Continued)

OTHER PUBLICATIONS

Murakami, The Neural Network model in case of music evaluation, vol. 99, No. 16, ISSN 0919-6072, Feb. 18, 1999, pp. 17-24.

(Continued)

*Primary Examiner*—David S. Warren
(74) *Attorney, Agent, or Firm*—Birch, Stewart, Kolasch & Birch, LLP

(57) ABSTRACT

A characteristic-data-extraction unit 13 extracts characteristic data containing changing information from song data, then an impression-data-conversion unit 14 uses a pre-learned hierarchical neural network to convert the characteristic data extracted by the characteristic-data-extraction unit 13 to impression data and stores it together with song data into a song database 15. A song search unit 18 searches the song database 15 based on impression data input from a PC-control unit 19, and outputs the search results to a search-results-output unit 21.

52 Claims, 16 Drawing Sheets

U.S. PATENT DOCUMENTS

| | | | | |
|---|---|---|---|---|
| 2005/0241463 | A1* | 11/2005 | Urata | 84/609 |
| 2006/0032363 | A1* | 2/2006 | Platt | 84/601 |
| 2007/0208771 | A1* | 9/2007 | Platt | 707/102 |

FOREIGN PATENT DOCUMENTS

| | | | |
|---|---|---|---|
| EP | 1 244 093 | A3 | 9/2002 |
| EP | 1 304 628 | A2 | 4/2003 |
| EP | 1 304 628 | A3 | 4/2003 |
| JP | 2002-278547 | A | 9/2002 |

OTHER PUBLICATIONS

Fukumura et al., Music data Similarity Searching Method with both Filtering in Feature Space and Filtering in Melody Space, vol. 2003, No. 5, ISSN 0919-6072, Jan. 23 and 24, 2003, pp. 17-24.

XP002289491, "Moodlogic page", Moodlogic Website, Mar. 30, 2003.

Rauber et al., "Automatically Analyzing and Organizing Music Archives", Research and Advanced Technology for Digital Libraries. European Conference, ECDL. Proceedings, Sep. 4, 2001, pp. 402-414, XP002247540.

Feng et al., "Music Information Retrieval by Detecting Mood via Computational Media Aesthetics", Web Intelligence, 2003. WI 2003. Proceedings. IEEE/WIC International Conference on Oct. 13- 17, 2003, Piscataway, NJ, USA, IEEE, Oct. 13, 2003, pp. 235-241, XP010662937.

Feng Y et al., "Popular Music Retrieval by Detecting Mood", Sigir Forum, ACM, New York, NY, US, Jul. 1, 2003, pp. 375-376, XP009040410.

Elias Pampalk, "Island of Music Analysis, Organization, and Visualization of Music Archives", Internet Citation, Dec. 2001, XP002375938.

XP002376478, "Moodlogic Questions About Profiling", Moodlogic Website, 2 Apr. 2003.

* cited by examiner

Input vector $$x = [x_1, x_2, \Lambda, x_j]$$

SONG SEARCH SYSTEM AND SONG SEARCH METHOD

BACKGROUND OF THE INVENTION

1. Field of the Invention

This invention relates to a song search system and song search method that are used to search for a desired song from among a large quantity of song data stored in a large-capacity memory means such as a UMB, HDD or the like, and particularly to a song search system and song search method that are capable of searing for songs based on impression data that is determined according to human emotion.

2. Description of the Related Art

In recent years, large-capacity memory means such as an HDD have been developed, making it possible for large quantities of song data to be recorded in large-capacity memory means. Searching for large quantities of songs that are recorded in a large-capacity memory means has typically been performed by using bibliographic data such as artist's name, song title, keywords, etc., however, when searching using bibliographic data, it is not possible to take into consideration the feeling of the song, so there is a possibility that a song giving a different impression will be found, so this method is not suitable when it is desired to search for songs having the same impression when listened to.

Therefore, in order to be able to search for songs desired by the user based on subjective impression of the songs, an apparatus for searching for desired songs has been proposed in which the subjective conditions required by the user for songs desired to be searched for are input, quantified and output, and from that output, a predicted impression value, which is the quantified impression of the songs to be searched for, is calculated, and using the calculated predicted impression value as a key, a song database in which audio signals for a plurality of songs, and impression values, which are quantified impression values for those songs, are stored is searched to find desired songs based on the user's subjective image of a song (for example, refer to Japanese patent No. 2002-278547).

However, in the prior art, physical characteristics of songs that are converted to impression values are searched based on estimated impression values that are digitized from subjective requirements input by the user, so input items that are the subjective requirements input by the user as search conditions are consolidated, and there was a problem in that it was impossible to perform a highly precise search of song data based on subjective requirements.

Also, in the prior art, it was necessary for the user to perform complicated controls to input subjective impressions of the songs when performing a search, and since the estimated impression values that are digitized from the subjective requirements input by the user are not necessarily close to the impression of the target song, there was a problem in that it was not possible to quickly find songs having the same impression as the target song from among a large quantity of song data stored in a large-capacity memory means.

SUMMARY OF THE INVENTION

Taking the problems mentioned above into consideration, the object of this invention is to provide a song search system and song search method that are capable of performing a highly precise search of song data based on impression data determined according to human emotion, by using a hierarchical-type neural network and by directly correlating characteristic data comprising a plurality of physical items of the songs with impression data comprising items determined according to human emotion, without consolidating items of impression data determined according to human emotions input by the user as search conditions.

Also, taking the problems described into consideration, the object of this invention is to provide a song search system and song search method that are capable of quickly finding songs having the same impression as a representative song from among a large quantity of song data stored in a large-capacity memory means by a simple operation such as selecting a representative song.

In order to solve the problems mentioned above, this invention is constructed as described below.

The song search system of this invention is a song search system that searches for desired song data from among a plurality of song data stored in a song database, the song search system comprising: a song-data-input means of the inputting song data; a characteristic-data-extraction means of extracting physical characteristic data from song data input by the song-data-input means; an impression-data-conversion means of converting characteristic data extracted by the characteristic-data-extraction means to impression data determined by human emotion; a memory-control means of storing impression data converted by the impression-data-conversion means in a song database together with song data input by the song-data-input means; an impression-data-input means of inputting impression data as search conditions; a song search means of searching the song database based on impression data input from the impression-data-input means; and a song-data-output means of outputting song data found by the song search means.

Also, in the song search system of this invention, the impression-data-conversion means uses a pre-learned hierarchical-type neural network to convert characteristic data extracted by the characteristic-data-extraction means to impression data determined according to human emotion.

Moreover, in the song search system of this invention, the hierarchical-type neural network is learned using impression data input by an evaluator that listened to song data as a teaching signal.

Furthermore, in the song search system of this invention, the characteristic-data-extraction means extracts a plurality of items containing changing information as characteristic data.

Also, in the song search system of this invention, impression data converted by the impression-data-conversion means and impression data input from the impression-data-input means contain the same number of a plurality of items.

Moreover, in the song search system of this invention, the song search means uses impression data input from the impression-data-input means as input vectors, and uses impression data stored in the song database as target search vectors, to perform a search in order of the smallest Euclidean distance of both.

Also, the song search system of this invention is a song search system comprising a song search apparatus that searches desired song data from among a plurality of song data stored in a song database, and a terminal apparatus that can be connected to the song search apparatus; and wherein the song search apparatus further comprises: a song-data-input means of inputting the song data; a characteristic-data-extraction means of extracting physical characteristic data from song data input by the song-data-input means; an impression-data-conversion means of converting characteristic data extracted by the characteristic-data-extraction means to impression data determined according to human emotion; a memory-control means of storing impression data converted by the impression-data-conversion means in a song database together with song data input by said song-data-input means; an impression data-input means of inputting impression data as search conditions; a song search means of searching the song-data database based on impression data input from the impression-data-input means; and a song-data-output means of outputting song data found by the song search means to the terminal apparatus; and wherein the terminal apparatus comprises: a search-results-input means of inputting song data from the song search apparatus; a search-results-memory means of storing song data input by the search-results-input means; and an audio-output means of reproducing song data stored in the search-results-memory means.

Also, in the song search system of this invention, the impression-data-conversion means uses a pre-learned hierarchical-type neural network to convert characteristic data extracted by the characteristic-data-extraction means to impression data determined according to human emotion.

Moreover, in the song search system of this invention, the hierarchical-type neural network is learned using impression data input by an evaluator that listened to song data as a teaching signal.

Furthermore, in the song search system of this invention, the characteristic-data-extraction means extracts a plurality of items containing changing information as characteristic data.

Also, in the song search system of this invention, impression data converted by the impression-data-conversion means and impression data input from the impression-data-input means contain the same number of a plurality of items.

Moreover, in the song search system this invention, the song search means uses impression data input from the impression-data-input means as input vectors, and uses impression data stored in the song database as target search vectors, to perform a search in order of the smallest Euclidean distance of both.

The song search system of this invention is a song search system comprising: a song-registration apparatus that stores input song data in a song database, and a terminal apparatus that can be connected to the song-registration apparatus, and wherein the song-registration apparatus further comprises: a song-data-input means of inputting the song data; a characteristic-data-extraction means of extracting physical characteristic data from song data input by the song-data-input means; an impression-data-conversion means of converting characteristic data extracted by the characteristic-data-extraction means to impression data determined according to human emotion; a memory-control means that stores impression data converted by the impression-data-conversion means in a song database together with song data input by the song-data-input means; and a database-output means of outputting song data and impression data stored in the song database to the terminal apparatus; and wherein the terminal apparatus further comprises: a database-input means of inputting song data and impression data from the song-registration apparatus; a terminal-side song database that stores song data and impression data input by the database-input means; an impression-data-input means of inputting impression data as search conditions; a song search means of searching the terminal-side song database based on impression data input from the impression-data-input means; and an audio-output means of reproducing song data found by the song search means.

Also, in the song search system of this invention, the impression-data-conversion means uses a pre-learned hierarchical-type neural network to convert characteristic data extracted by the characteristic-data-extraction means to impression data determined according to human emotion.

Moreover, in the song search system of this invention, the hierarchical-type neural network is learned using impression data input by an evaluator that listened to song data as a teaching signal.

Furthermore, in the song search system of this invention, the characteristic-data-extraction means extracts a plurality of items containing changing information as characteristic data.

Also, in the song search system of this invention, impression data converted by the impression-data-conversion means and impression data input from the impression-data-input means contain the same number of a plurality of items.

Moreover, in the song search system of this invention, the song search means uses impression data input from the impression-data-input means as input vectors, and uses impression data stored in the terminal-side song database as target search vectors, and performs a search in order of the smallest Euclidean distance of both.

Also, the song search method of this invention is a song search method of searching for desired song data from among a plurality of song data stored in a song database, the song search method comprising: receiving-input the song data; extracting physical characteristic data from the input song data; converting the extracted characteristic data to impression data determined according to human emotion; storing converted impression data in a song database together with the received song data; receiving input impression data as search conditions; searching the song database based on received impression data; and outputting the found song data.

Moreover, the song search method of this invention uses a pre-learned hierarchical-type neural network to convert the extracted characteristic data to impression data determined according to human emotion.

Furthermore, the song search method of this invention uses the hierarchical-type neural network, which is pre-learned using impression data input by an evaluator that listened to song data as a teaching signal, to convert the extracted characteristic data to impression data determined according to human emotion.

Also, the song search method of this invention extracts a plurality of items containing changing information as characteristic data.

Moreover, in the song search method of this invention, the converted impression data and the received impression data contain the same number of a plurality of items.

Furthermore, the song search method of this invention uses the received impression data as input vectors, and uses impression data stored in the song database as target search vectors, to perform a search in order of the smallest Euclidean distance of both.

Also, the song search system of this invention is a song search system that searches for desired song data from among a plurality of song data stored in a song database, the song search system comprising: a song-data-input means of inputting the song data; a characteristic-data-extraction means of extracting physical characteristic data from song data input by the song-data-input means; an impression-data-conversion means of converting characteristic data extracted by the characteristic-data-extraction means to impression data determined according to human emotion; a song-mapping means that, based on impression data converted by the impression-data-conversion means, maps song data input by the song-data-input means onto a song map, which is a pre-learned self-organized map; a song-map-memory means of storing song data that are mapped by the song-mapping means; a representative-song-selection means of selecting a representative song from among song data mapped on the song map; a song search means of searching a song map based on a representative song selected by the representative-song-selection means; and a song-data-output means of outputting song data found by the song search means.

Moreover, the song search system of this invention is a song search system comprising: a song-search apparatus that searches for desired song data from among a plurality of song data stored in a song database, and a terminal apparatus that can be connected to the song-search apparatus; and wherein the song search apparatus further comprises: a song-data-input means of inputting the song data; a characteristic-data-extraction means of extracting physical characteristic data from song data input by the song-data-input means; an impression-data-conversion means of converting characteristic data extracted by the characteristic-data-extraction means to impression data determined according to human emotion; a song-mapping means that, based on impression data converted by the impression-data-conversion means, maps song data input by the song-data-input means onto a song map, which is a pre-learned self-organized map; a song-map-memory means that stores song data mapped by the song-mapping means; a representative-song-selection means of selecting a representative song from among song data mapped on a song map; a song search means of searching a song map based on a representative song selected by the representative-song-selection means; and a song-data-output means of outputting song data found by the song search means; and wherein the terminal apparatus further comprises: a search-results-input means of inputting song data from the song-search apparatus; a search-results-memory means of storing song data input by the search-results-input means; and an audio-output means of reproducing song data stored in the search-results-memory means.

Also, the song search system of this invention is a song search system comprising a song-registration apparatus that stores input song data in a song database, and a terminal apparatus that can be connected to the song-registration apparatus; wherein the song-registration apparatus further comprises: a song-data-input means of inputting the song data; a characteristic-data-extraction means of extracting physical characteristic data from song data input by the song-data-input means; an impression-data-conversion means of converting characteristic data extracted by the characteristic-data-extraction means to impression data determined according to human emotion; a song-mapping means that, based on impression data converted by the impression-data-conversion means, maps song data input by the song-data-input means onto a song map, which is a pre-learned self-organized map; a song-map-memory means of storing song data mapped by the song-mapping means; and a database-output means of outputting song data stored in the song database, and the song map stored in the song-map-memory means in the terminal apparatus; and wherein the terminal apparatus further comprises: a database-input means of inputting song data and song map from the song-registration apparatus; a terminal-side song database that stores song data input by the database-input means; a terminal-side song-map-memory means of storing a song map input by the database-input means; a representative-song-selection means of selecting a representative song from among song data mapped on a song map; a song-search means of searching a song map based on a representative song selected by the representative-song-selection means; and an audio-output means of reproducing song data found by the song search means.

Moreover, in the song search system of this invention, the impression-data-conversion means uses a pre-learned hierarchical-type neural network to convert characteristic data extracted by the characteristic-data-extraction means to impression data determined according to human emotion.

Furthermore, in the song search system of this invention, the hierarchical-type neural network is learned using impression data, which is input by an evaluator that listened to song data, as a teaching signal.

Also, in the song search system of this invention, the characteristic-data-extraction means extracts a plurality of items of changing information as characteristic data.

Moreover, in the song search system of this invention, the song-mapping means uses impression data converted by the impression-data-conversion means as input vectors to map song data input by the song-data-input means onto neurons closest to the input vectors.

Furthermore, in the song search system of this invention, the song search means searches for song data contained in neurons for which a representative song is mapped.

Also, in the song search system of this invention, the song search means search for song data contained in neurons for which a representative song is mapped and contained in the proximity neurons.

Moreover, in the song search system of this invention, the proximity radius for determining proximity neurons by the song search means can be set arbitrarily.

Furthermore, in the song search system of this invention, learning is performed using impression data input by an evaluator that listened to the song data.

Also, the song search system of this invention is a song search system that searches for desired song data from among a plurality of song data stored in a song database, the song search system comprising: a song map that is a pre-learned self-organized map on which song data are mapped; a representative-song-selection means of selecting a representative song from among song data mapped on a song map; a song-search means of searching a song map based on a representative song selected by the representative-song-selection means; and a song-data-output means of outputting song data found by the song-search means.

Moreover, in the song search system of this invention, song data is mapped on a song map using impression data that contain the song data as input vectors.

Furthermore, in the song search system of this invention, the song-search means searches for song data contained in neurons for which a representative song is mapped.

Also, in the song search system of this invention, the song-search means searches for song data contained in neutrons for which a representative song is mapped and contained in the proximity neurons.

Moreover, in the song search system of this invention, the proximity radius for setting the proximity neurons by the song search means can be set arbitrarily.

Furthermore, in the song search system of this invention, the song map performed a learning using impression data input by an evaluator that listened to song data.

Also, the song search method of this invention is a song search method of searching for desired song data from among a plurality of song data stored in a song database; the song search method comprising: receiving input the song data; extracting physical characteristic data from the input song data; converting the extracted characteristic data to impression data determined according to human emotion; mapping the received song data onto a song map, which is a pre-learned self-organized map, based on the converted impression data; selecting a representative song from among song data mapped on a song map; searching for song data mapped on song map based on the selected representative song; and outputting found song data.

Moreover, the song search method of this invention uses a pre-learned hierarchical-type neural network to convert the extracted characteristic data to impression data determined according to human emotion.

Furthermore, the song search method of this invention uses the hierarchical-type neural network, which was pre-learned using impression data input by an evaluator that listened to song data as a teaching signal, to convert the extracted characteristic data to impression data determined according to human emotion.

Also, the song search method of this invention extracts a plurality of items containing changing information as characteristic data.

Moreover, the song search method of this invention uses the converted impression data as input vectors to map the input song data on neurons nearest to the input vectors.

Furthermore, the song search method of this invention searches for song data contained in neurons for which a representative song is mapped.

Also, the song search method of this invention searches for song data contained in neurons for which a representative song is mapped, and contained in proximity neurons.

Moreover, in the song search method of this invention, the proximity radius for determining proximity neurons can be set arbitrarily.

Furthermore, in the song search method of this invention, the song map performed a learning using impression data input by an evaluator that listened to the song data.

Also, the song search method of this invention is a song search method of searching for desired song data from among a plurality of song data stored in a song database, the song search method comprising: selecting a representative song from among song data mapped on a song map that is a pre-learned self-organized map on which song data are mapped; searching for song data that are mapped on song map based on the selected representative song; and outputting the found song data.

Moreover, in the song search method of this invention a song data is mapped on a song map using impression data that contains the song data as input vectors.

Furthermore, the song search method of this invention searches for song data contained in neurons for which a representative song is mapped.

Also, the song search method of this invention searches for song data contained in neurons for which a representative song is mapped, and contained in the proximity neurons.

Moreover, in the song search method of this invention the proximity radius for setting proximity neurons can be set arbitrarily.

Furthermore, in the song search method of this invention the song map performed a learning using impression data input by an evaluator that listened to the song data.

DETAILED DESCRIPTION OF THE PREFERRED EMBODIMENTS

The preferred embodiment of the present invention will be explained below based on the drawings.

Figure 1:
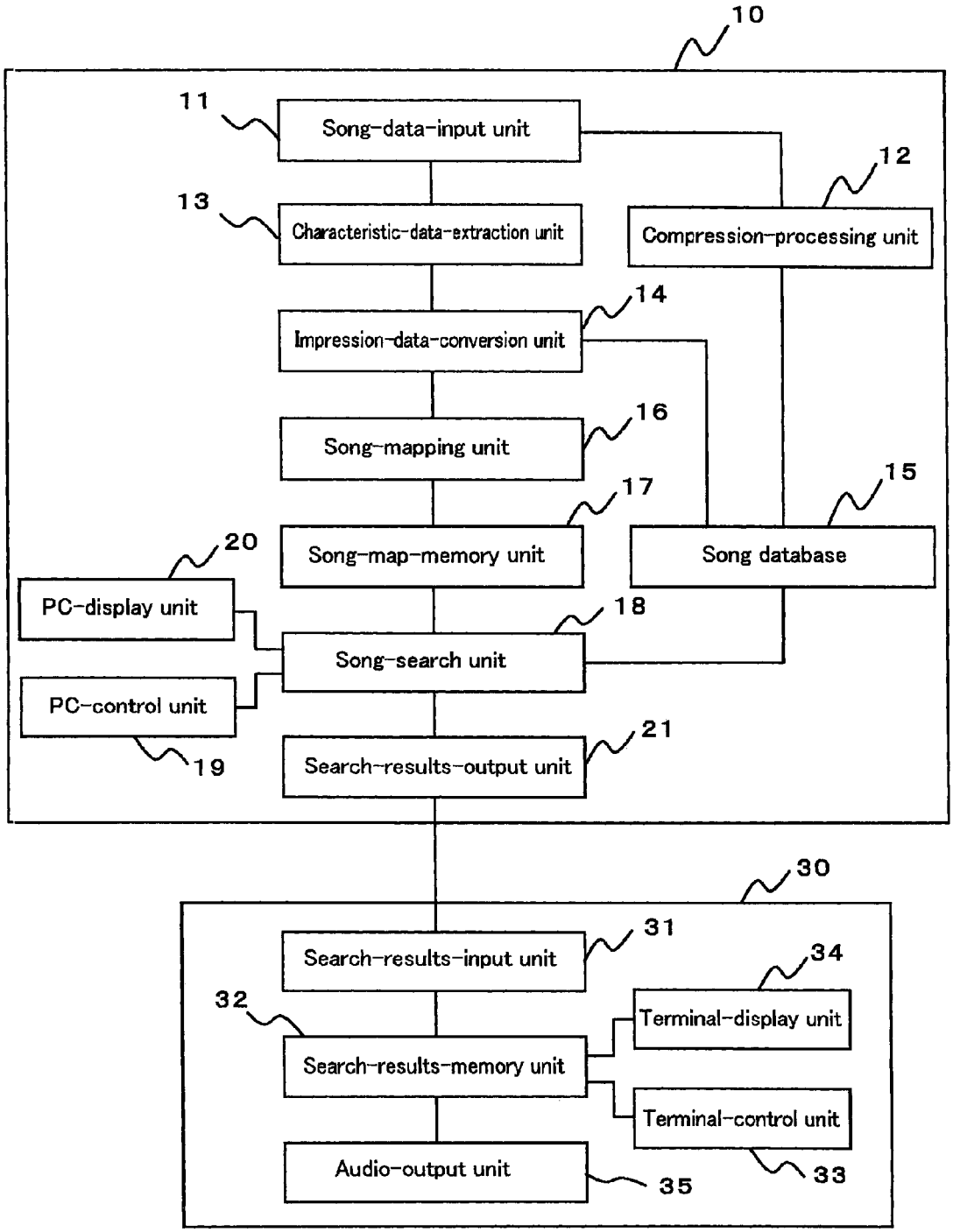
FIG. 1 is a block diagram showing the construction of an embodiment of the song search system of the present invention.
Figure 2:
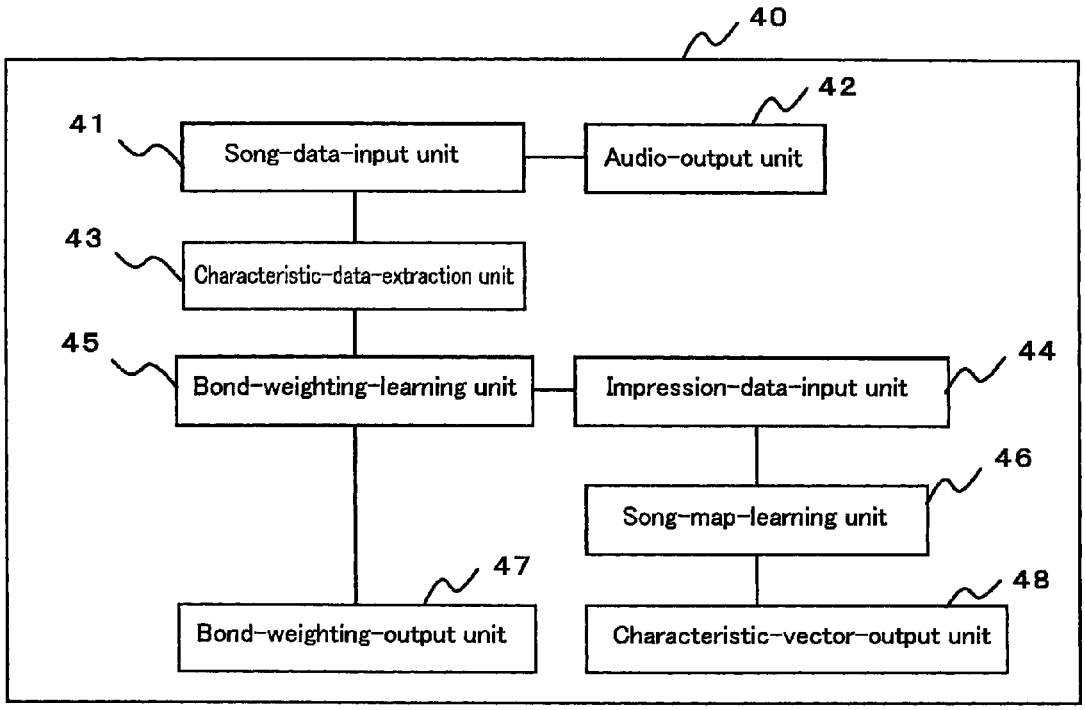
FIG. 2 is a block diagram showing the construction of a neural-network-learning apparatus that learns in advance a neural network used by the song search apparatus shown in FIG. 1.

FIG. 1 is a block diagram showing the construction of an embodiment of the song search system of the present invention, and FIG. 2 is a block diagram showing the construction of a neural-network-learning apparatus that learns in advance a neural network that is used in the song search apparatus shown in FIG. 1.

As shown in FIG. 1, the embodiment of the present invention comprises a song search apparatus 10 and terminal apparatus 30 that are connected by a data-transmission path such as USB or the like, and where the terminal apparatus 30 can be separated from the song search apparatus 10 and become mobile.

As shown in FIG. 1, the song search apparatus 10 comprises: a song-data-input unit 11, a compression-processing unit 12, a characteristic-data-extraction unit 13, an impression-data-conversion unit 14, a song database 15, a song-mapping unit 16, a song-map-memory unit 17, a song search unit 18, a PC-control unit 19, a PC-display unit 20 and a search-results-output unit 21.

The song-data-input unit 11 has the function of reading a memory medium such as a CD, DVD or the like on which song data is stored, and is used to input song data from a memory medium such as a CD, DVD or the like and output it to the compression-processing unit 12 and characteristic-data-extraction unit 13. Instead of a memory medium such as a CD, DVD or the like, it is also possible to input song data (distribution data) by way of a network such as the Internet.

When compressed song data is input, it expands the compressed song data and outputs it to the characteristic-data-extraction unit 13.

The compression-processing apparatus 12 compresses the song data input from the song-data-input unit 11 by a compressing format such as MP3 or ATRAC (Adaptive Transform Acoustic Coding) or the like, and stores the compressed song data into the song database 15 together with bibliographic data such as the artist name, song title, etc.

The characteristic-data-extraction unit 13 extracts characteristic data containing changing information from the song data input from the song-data-input unit 11, and outputs the extracted characteristic data to the impression-data-conversion unit 14.

The impression-data-conversion unit 14 uses a pre-learned hierarchical-type neural network to convert the characteristic data input from the characteristic-data-extraction unit 13 to impression data that is determined according to human emotion, and outputs the converted impression data to the song-mapping unit 16.

The song database 15 is a large-capacity memory means such as a HDD or the like, and it correlates and stores the song data and bibliographic data compressed by the compression-processing unit 12, with the characteristic data extracted by the characteristic-data-extraction unit 13.

Based on the impression data input from the impression-data-conversion unit 14, the song-mapping unit 16 maps song data onto a self-organized song map for which pre-learning is performed in advance, and stores the song map on which song data has been mapped in a song-map-memory unit 17.

The song-map-memory unit 17 is a large-capacity memory means such as a HDD or the like, and stores a song map on which song data is mapped by the song-mapping unit 16.

The song search unit 18 searches the song database 15 based on the impression data and bibliographic data that are input from the PC-control unit 19, and displays the search results on the PC-display unit 20, as well as searches the song-map-memory unit 17 based on a representative song that is selected using the PC-control unit 19, and displays the search results of representative song on the PC-display unit 20. Also, the song search unit 18 outputs song data selected using the PC-control unit 19 to the terminal apparatus 30 by way of the search-result-output unit 21.

The PC-control unit 19 is an input means such as a keyboard, mouse or the like, and is used to perform input of search conditions for searching song data stored in the song database 15 and song-map-memory unit 17, and is used to perform input for selecting song data to output to the terminal apparatus 30.

The PC-display unit 20 is a display means such as a liquid-crystal display or the like, and it is used to display the mapping status of the song map stored in the song-map-memory unit 17; display search conditions for searching song data stored in the song database 15 and song-map-memory unit 17; and display found song data (search results).

The search-results-output unit 21 is constructed such that it can be connected to the search-results-input unit 31 of the terminal apparatus 30 by a data-transmission path such as a USB or the like, and it outputs the song data searched by the song search unit 18 and selected by the PC-control unit 19 to the search-results-input unit 31 of the terminal apparatus 30.

The terminal apparatus 30 is an audio-reproduction apparatus such as a portable audio player that has a large-capacity memory means such as a HDD or the like, and as shown in FIG. 1, it comprises: a search-results-input unit 31, search-results-memory unit 32, terminal-control unit 33, terminal-display unit 34 and audio-output unit 35.

The search-results-input unit 31 is constructed such that it can be connected to the search-results-output unit 21 of the song search apparatus 10 by a data-transmission path such as USB or the like, and it stores song data input from the search-results-output unit 21 of the song search apparatus 10 in the search-results-memory unit 32.

The terminal-control unit 33 is used to input instructions to select or reproduce song data stored in the search-results-memory unit 32, and performs input related to reproducing the song data such as input of volume controls or the like.

The terminal-display unit 34 is a display means such as a liquid-crystal display or the like, that displays the song title of a song being reproduced or various control guidance.

The audio-output unit 35 is an audio player that expands and reproduces song data that is compressed and stored in the search-results-memory unit 32.

The neural-network-learning apparatus 40 is an apparatus that learns a hierarchical-type neural network that is used by the impression-data-conversion unit 14, and a song map that is used by the song-mapping unit 16, and as shown in FIG. 2, it comprises: a song-data-input unit 41, an audio-output unit 42, a characteristic-data-extraction unit 43, an impression-data-input unit 44, a bond-weighting-learning unit 45, a song-map-learning unit 46, a bond-weighting-output unit 47, and a characteristic-vector-output unit 48.

The song-data-input unit 41 has a function for reading a memory medium such as a CD, DVD or the like on which song data are stored, and inputs song data from the memory medium such as a CD, DVD or the like and outputs it to the audio-output unit 42 and characteristic-data-extraction unit 43. Instead of a memory medium such as a CD, DVD or the like, it is also possible to input song data (distribution data) by way of a network such as a Internet. When compressed song data is input, it expands the compressed song data, and output it to the audio-output unit 42 and characteristic-data-extraction unit 43.

The audio-output unit 42 is an audio player that expands and reproduces the song data input from the song-data-input unit 41.

The characteristic-data-expansion unit 43 extracts characteristic data containing changing information from the song data input from the song-data-input unit 41, and outputs the extracted characteristic data to the bond-weighting-learning unit 45.

Based on the audio output from the audio-output unit 42, the impression-data-input unit 44 receives the impression data input from an evaluator, and outputs the received impression data to the bond-weighting-learning unit 45 as a teaching signal to be used in learning the hierarchical-type neural network, as well as outputs it to the song-map-learning unit 46 as input vectors for the self-organized map.

Based on the characteristic data input from the characteristic-data-extraction unit 43 and the impression data input from the impression-data-input unit 44, the bond-weighting-learning unit 45 learns the hierarchical-type neural network and updates the bond-weighting values for each of the neurons, then outputs the updated bond-weighting values by way of the bond-weighting output unit 47. The learned hierarchical-type neural network (updated bond-weighting values) is transferred to the impression-data-conversion unit 14 of the song search apparatus 10.

The song-map-learning unit 46 learns the self-organized map using impression data input from the impression-data-input unit 44 as input vectors for the self-organized map, and updates the characteristic vectors for each neuron, then outputs the updated characteristic vectors by way of the characteristic-vector-output unit 48. The learned self-organized map (updated characteristic vector) is stored in the song-map-memory unit 17 of the song search apparatus 10 as a song map.

Next, FIG. 3 to FIG. 15 will be used to explain in detail the operation of the embodiment of the present invention.

Figure 3:
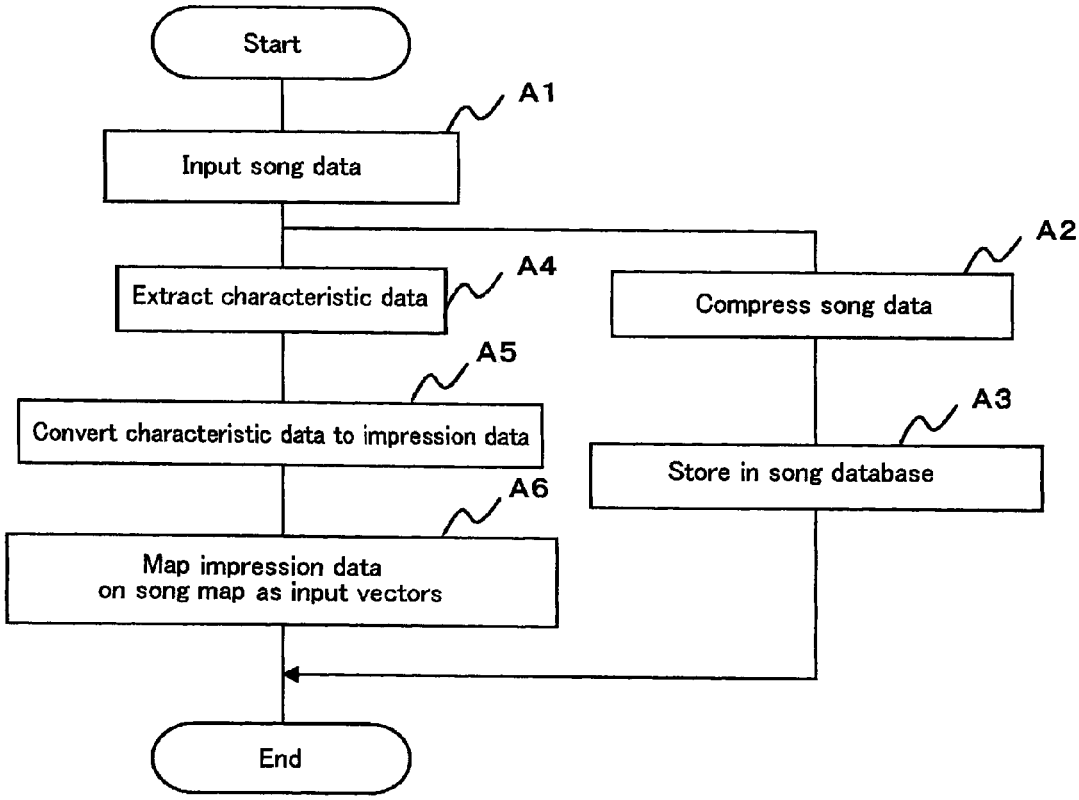
FIG. 3 is a flowchart for explaining the song-registration operation by the song search apparatus shown in FIG. 1.
Figure 4:
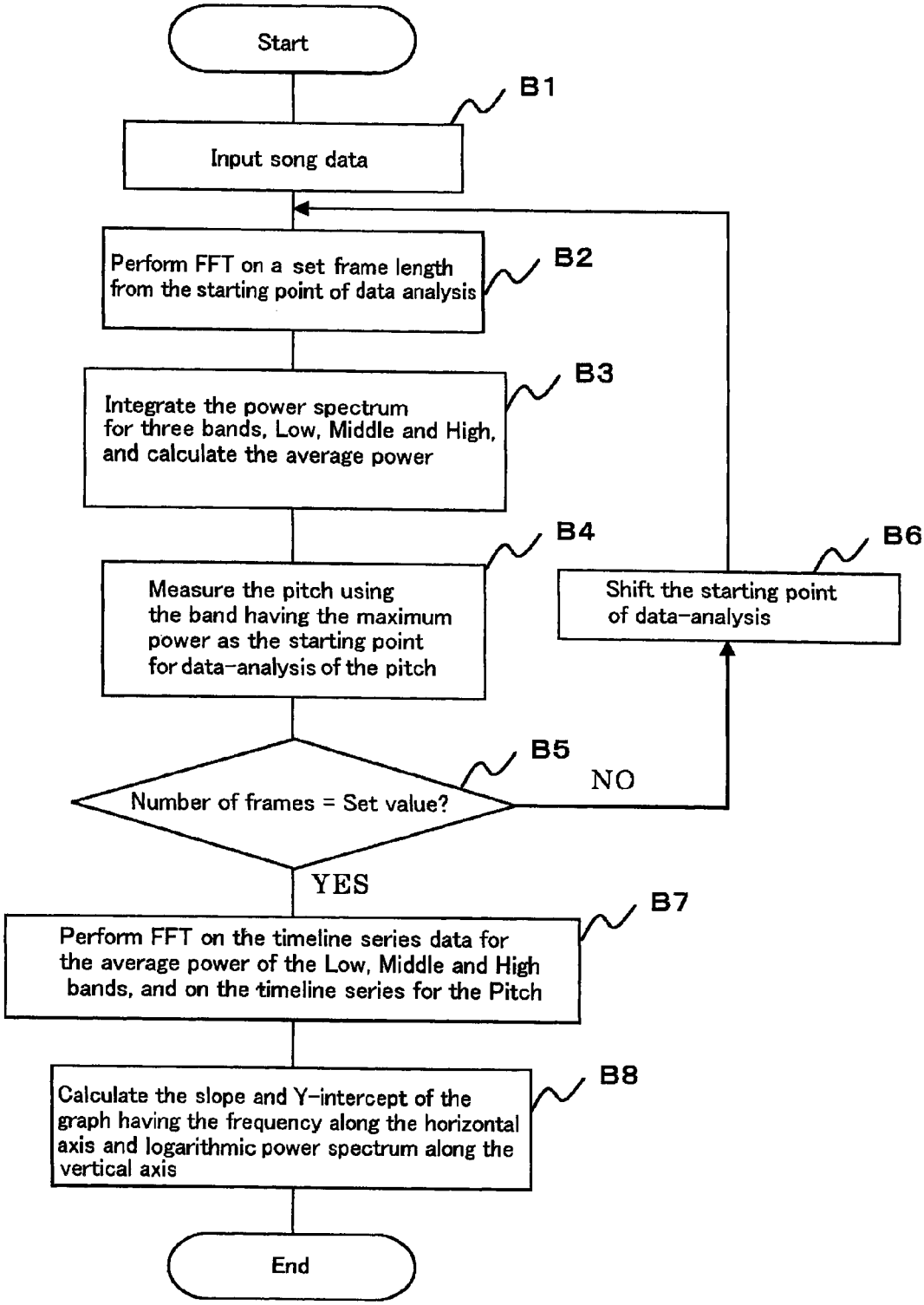
FIG. 4 is a flowchart for explaining the characteristic-data-extraction operation by the characteristic-data-extraction unit shown in FIG. 1.
Figure 5:
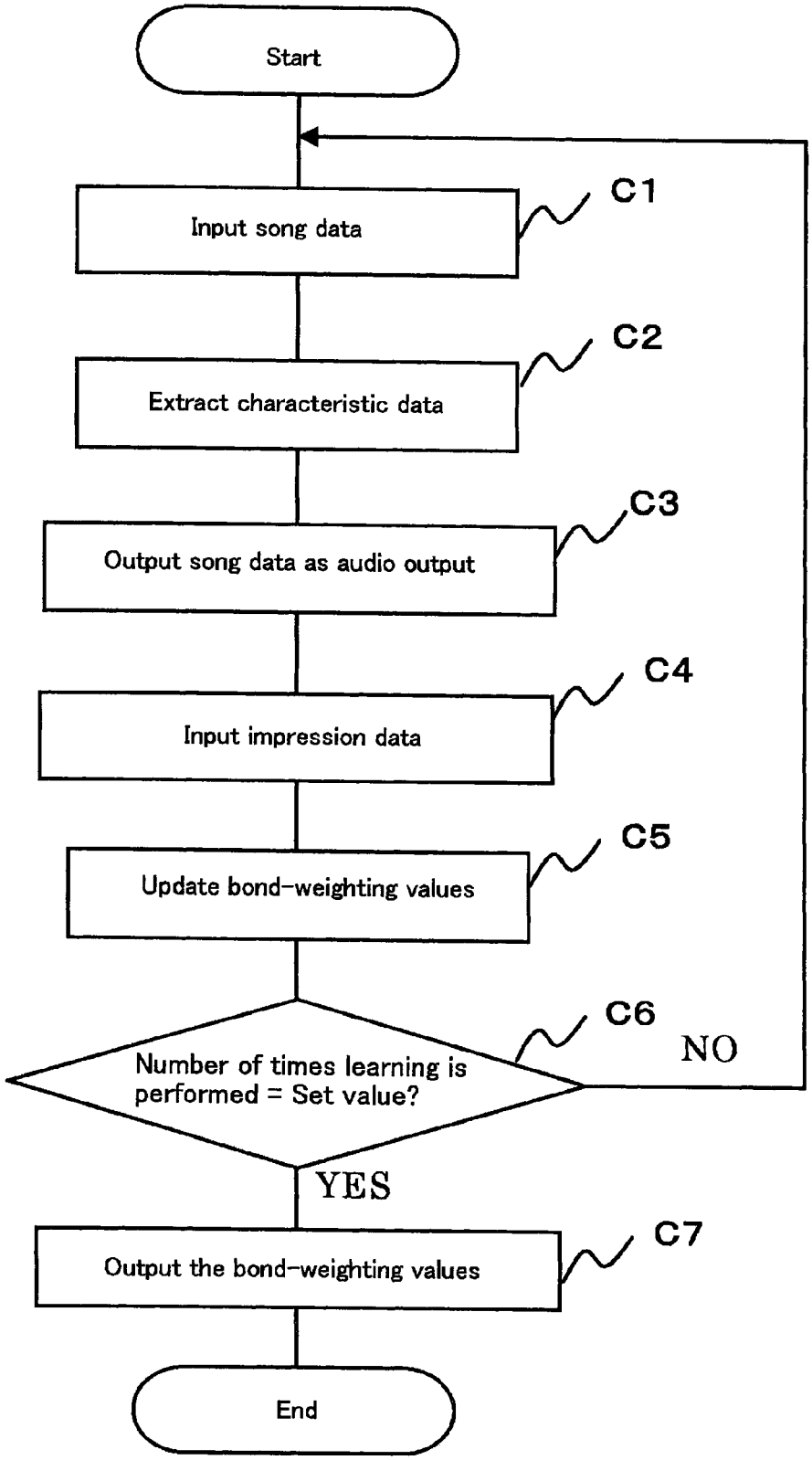
FIG. 5 is a flowchart for explaining the learning operation for learning a hierarchical-type neural network by the neural-network-learning apparatus shown in FIG. 2.
Figure 6:
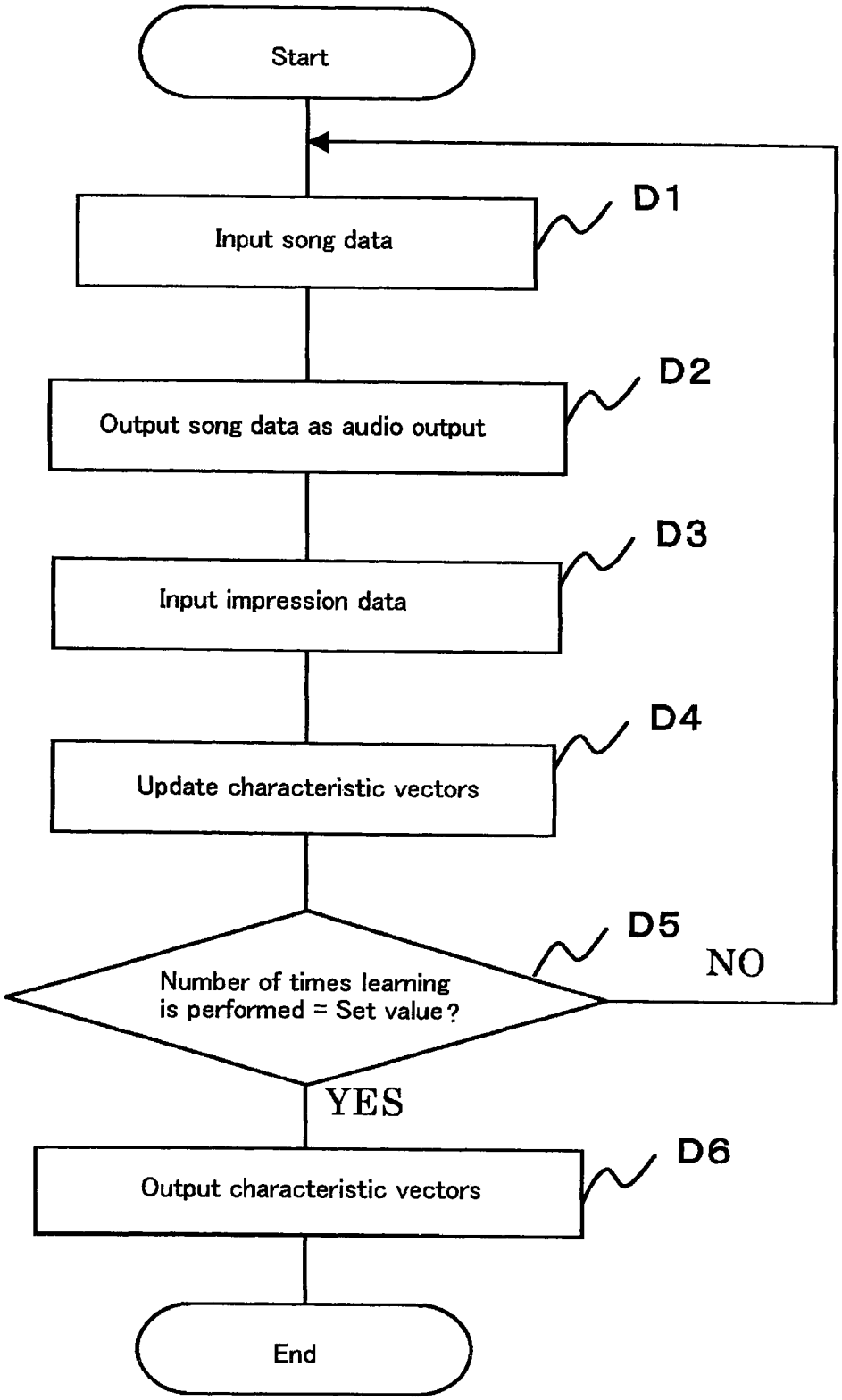
FIG. 6 is a flowchart for explaining the learning operation for learning a song map by the neural-network-learning apparatus shown in FIG. 2.
Figure 7:
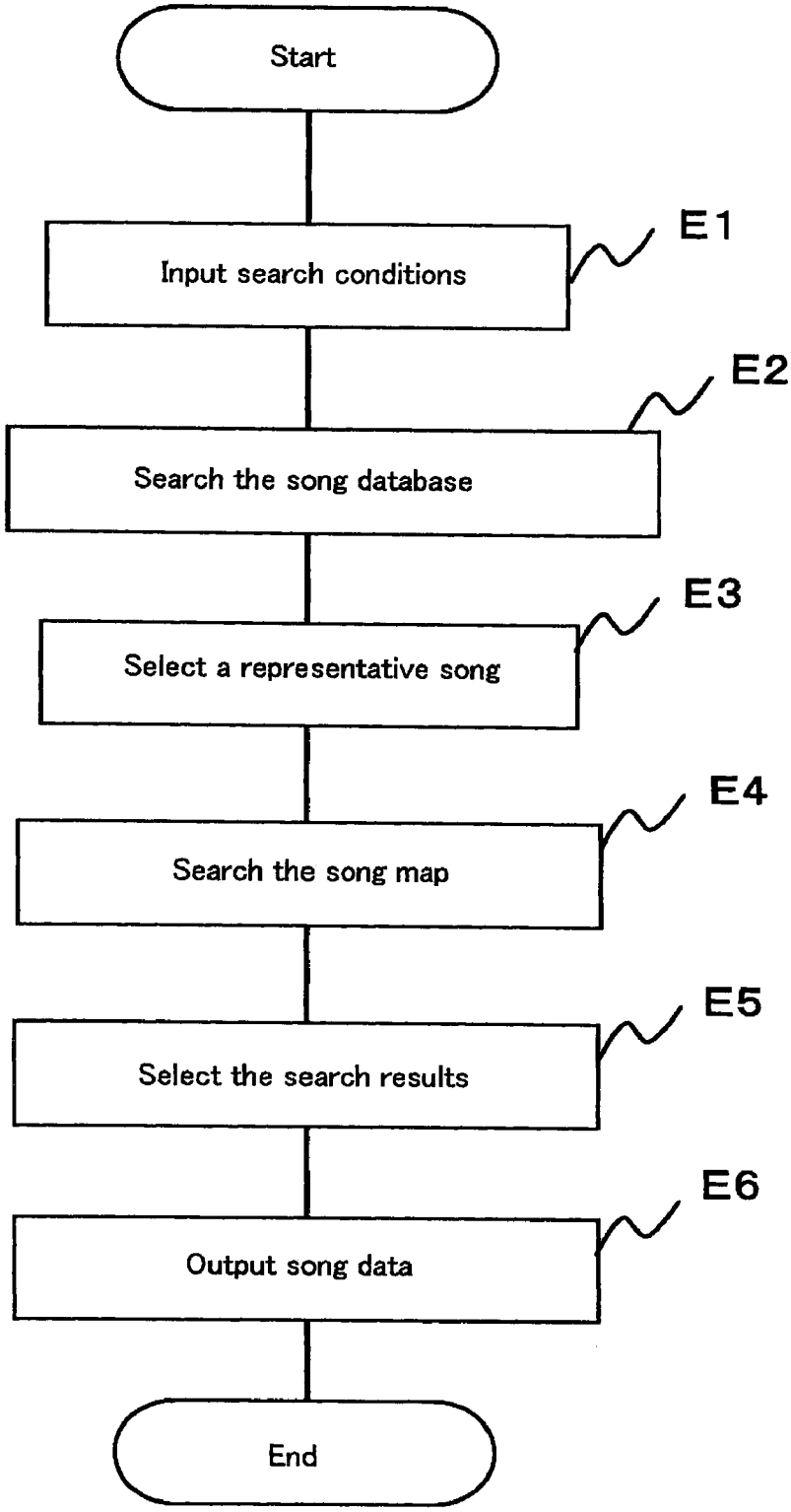
FIG. 7 is a flowchart for explaining the song search operation by the song search apparatus shown in FIG. 1.
Figure 8:
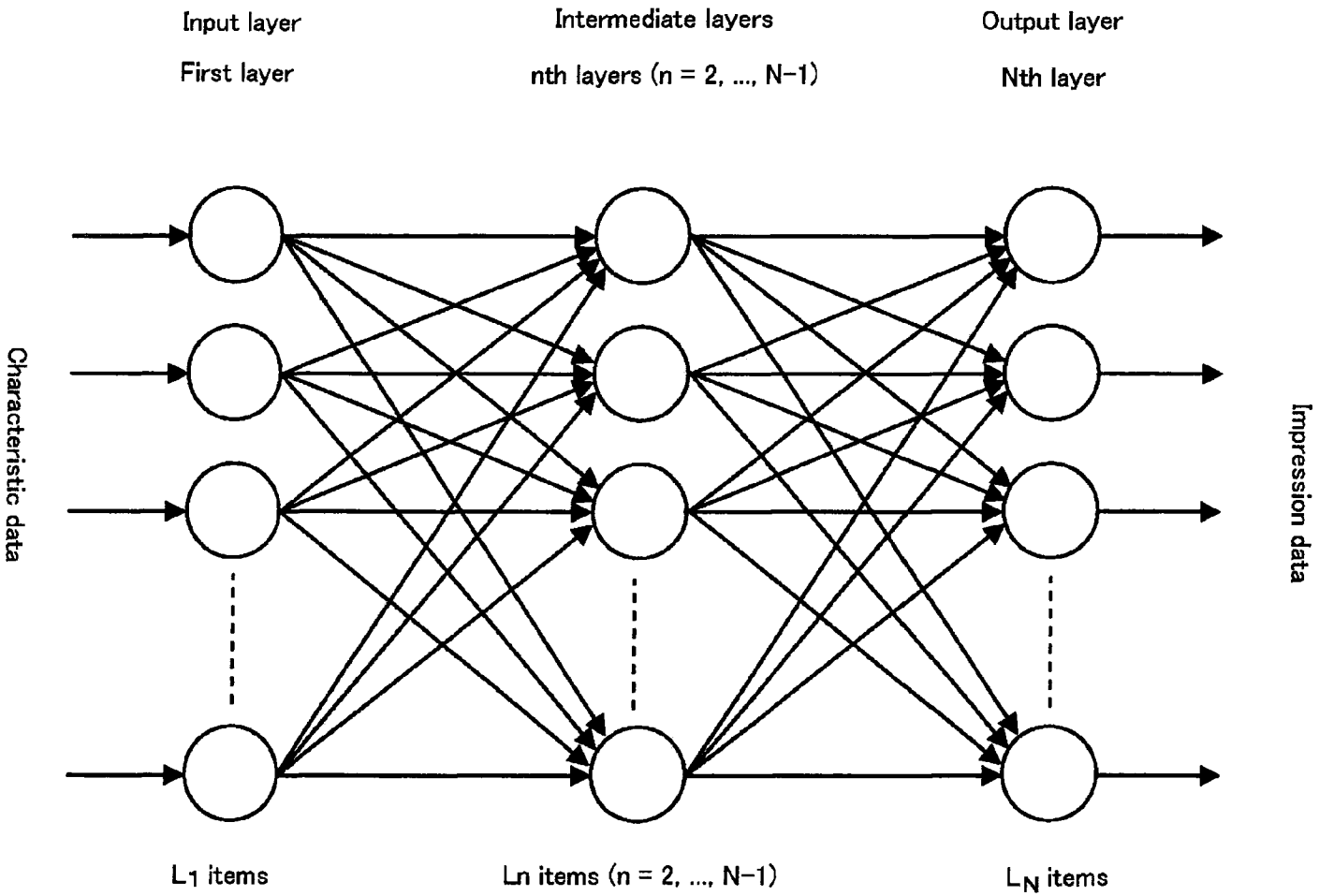
FIG. 8 is a drawing for explaining the learning algorithm for learning a hierarchical-type neural network by the neural-network-learning apparatus shown in FIG. 2.
Figure 9:
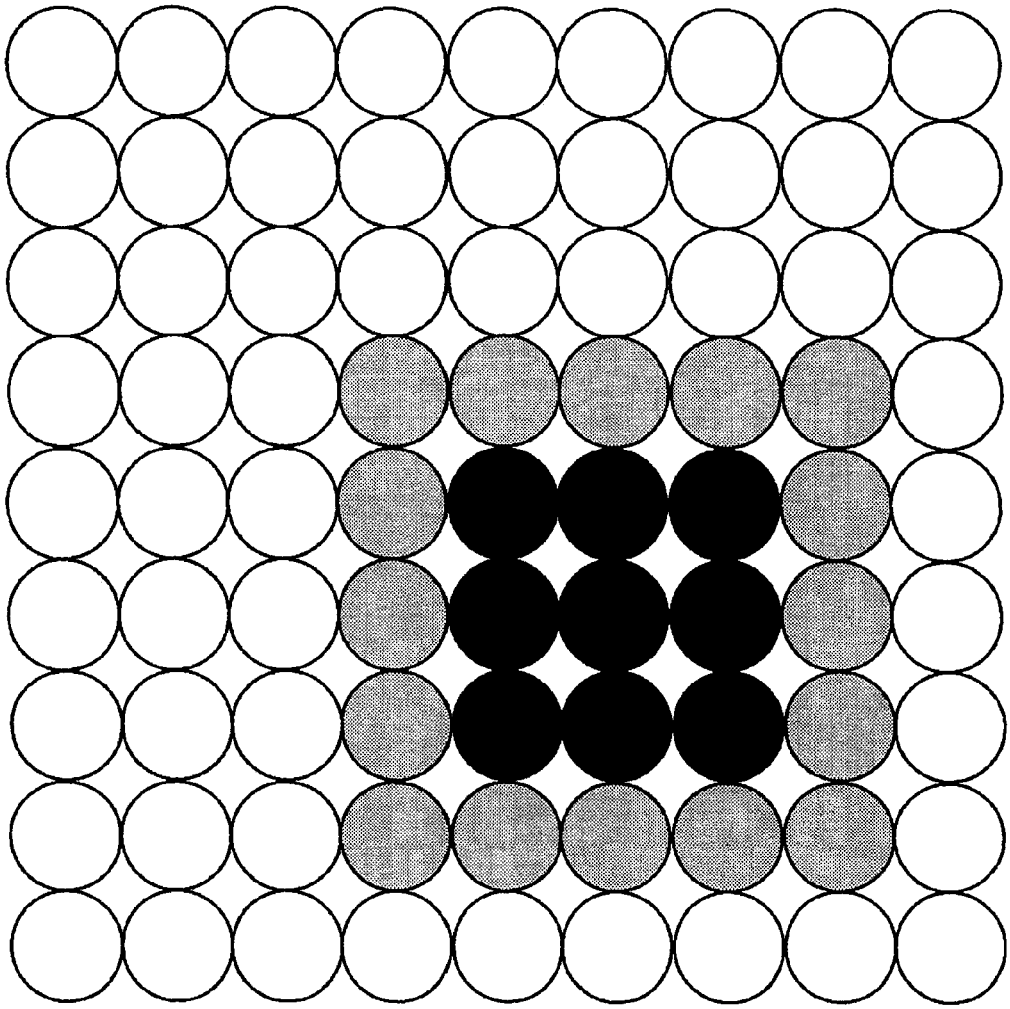
FIG. 9 is a drawing for explaining the learning algorithm for learning a song map by the neural-network-learning apparatus shown in FIG. 2.
Figure 9:
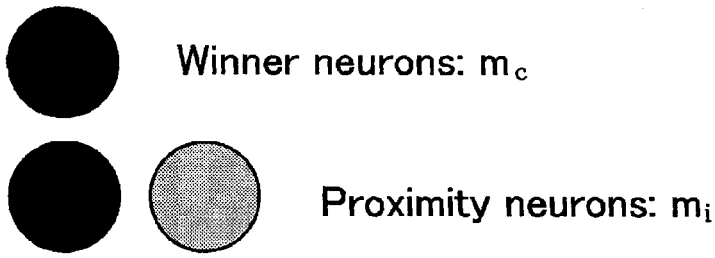
Figure 10:
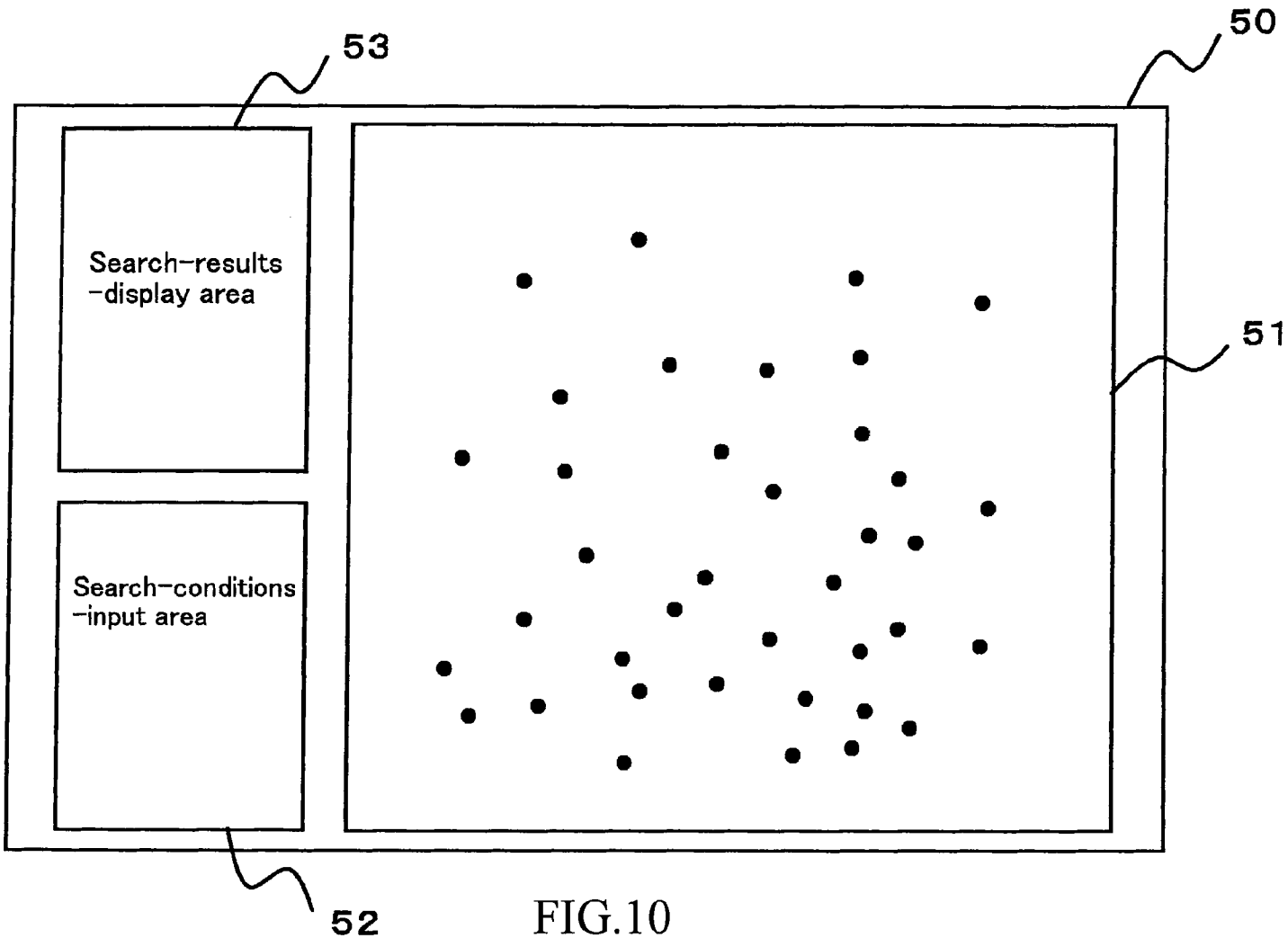
FIG. 10 is a drawing showing an example of the display screen of the PC-display unit shown in FIG. 1.
Figure 11:
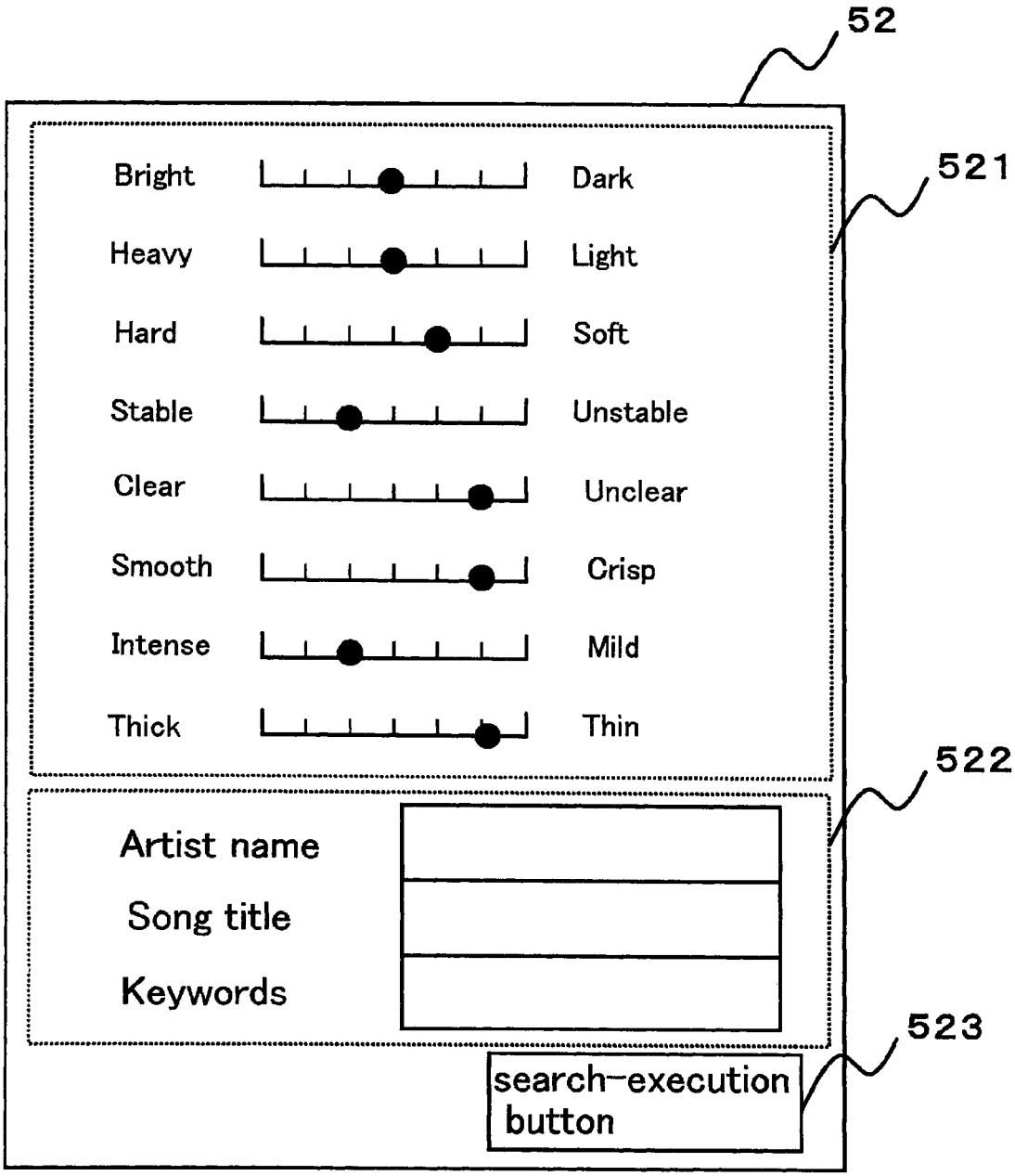
FIG. 11 is a drawing showing an example of the display of the search-conditions-input area shown in FIG. 10.
Figure 12:
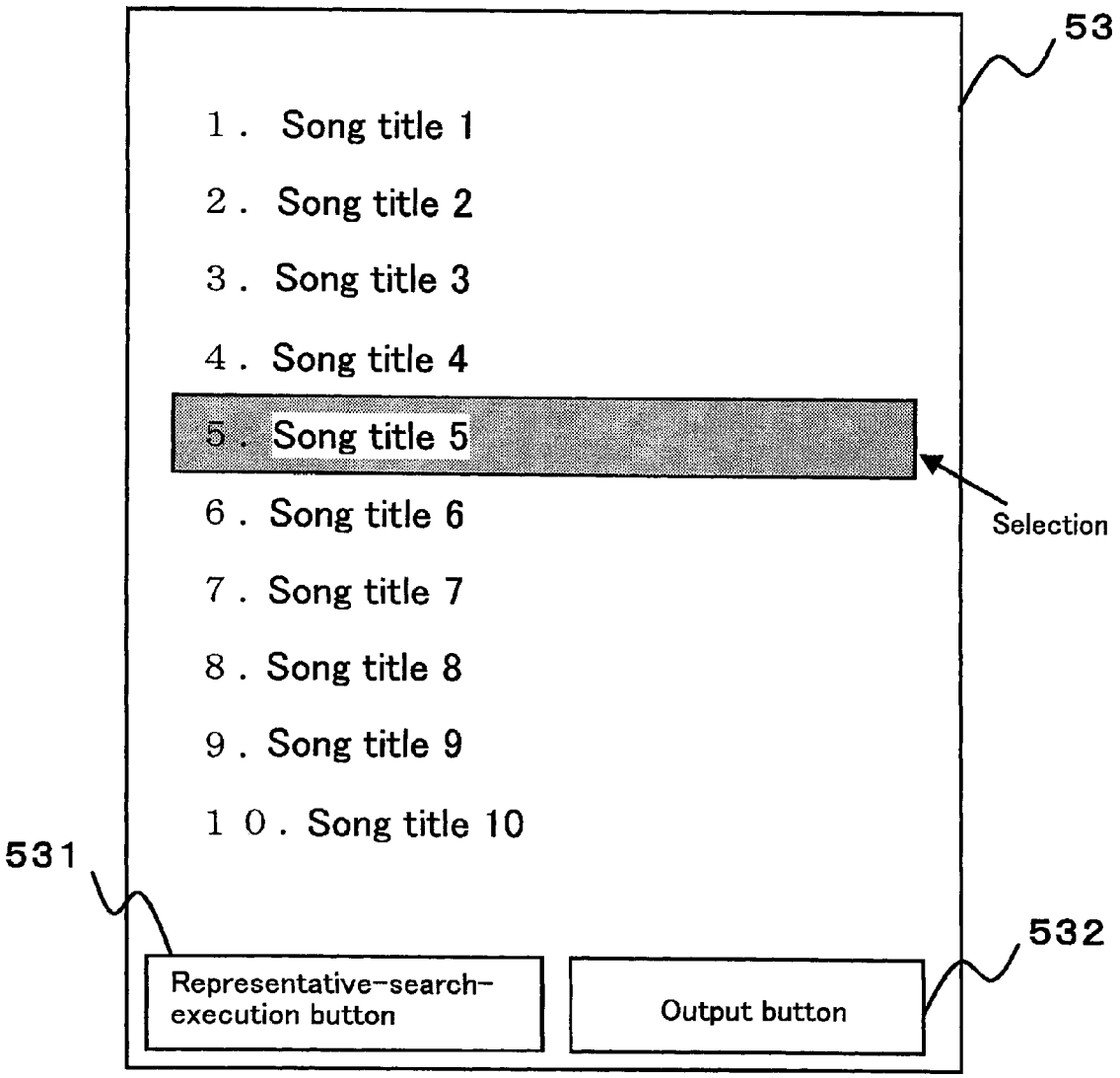
FIG. 12 is a drawing showing an example of the display of the search-results-display area shown in FIG. 10.
Figure 13:
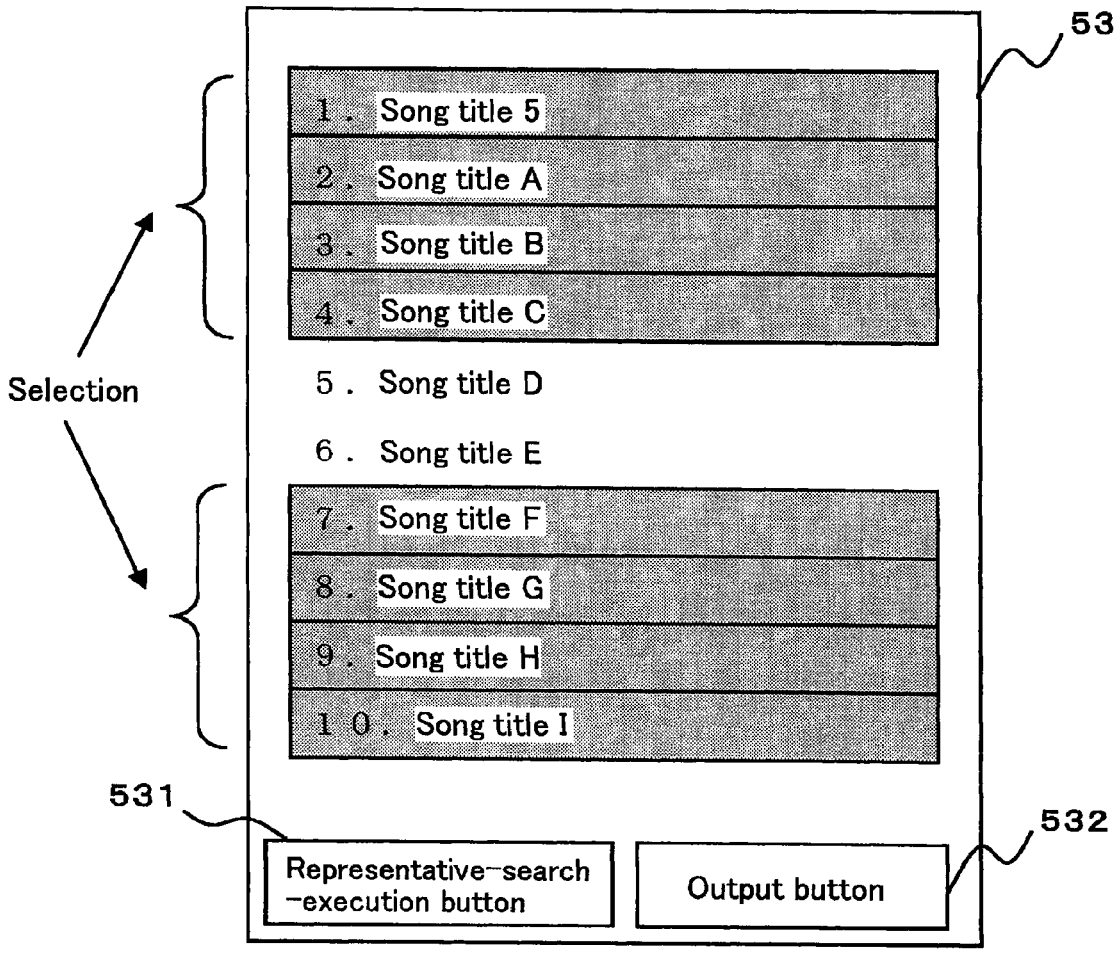
FIG. 13 is a drawing showing an example of the display of the search-results-display area shown in FIG. 10.
Figure 14:
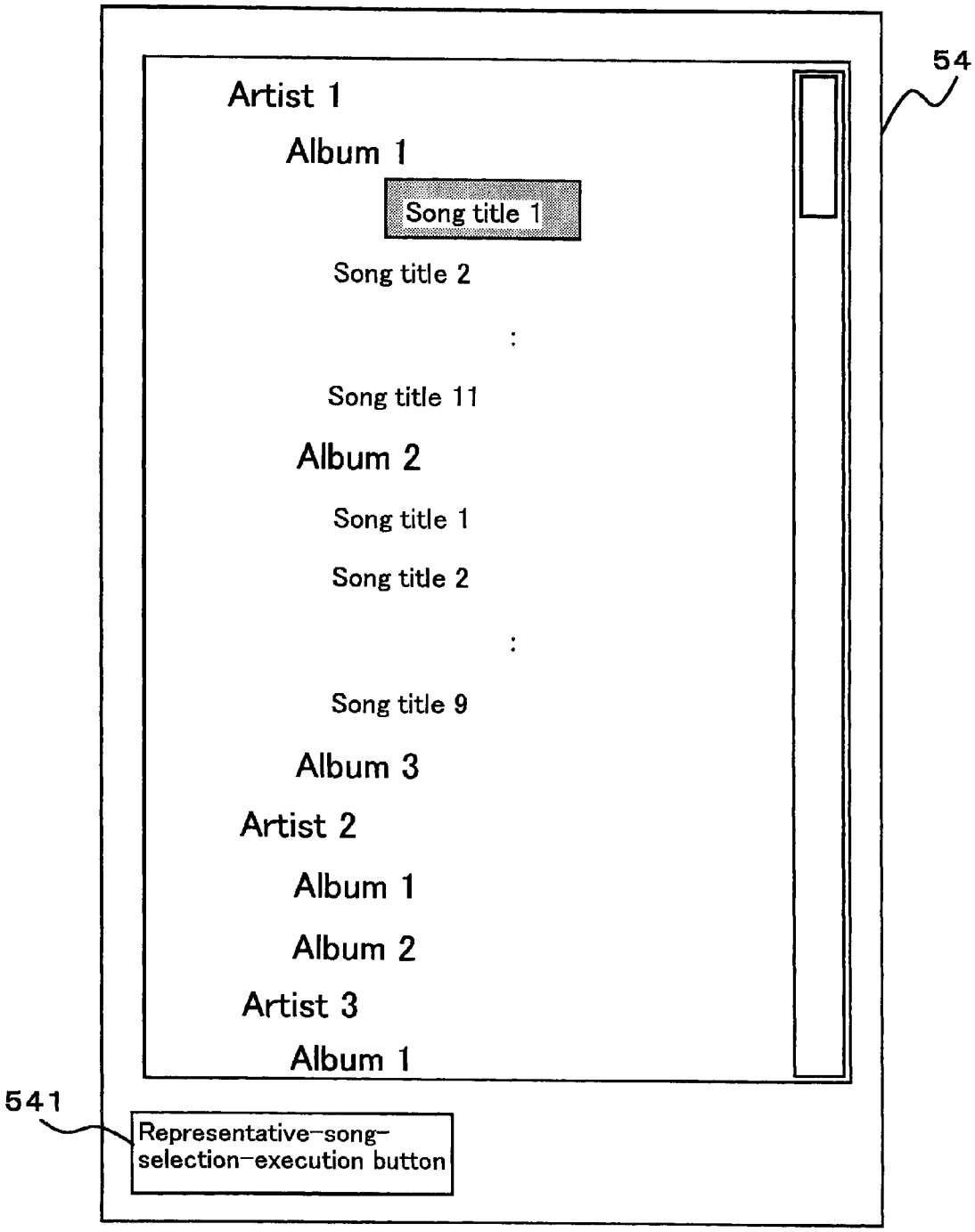
FIG. 14 is a drawing showing an example of the entire-song-list-display area that is displayed in the example of the display screen shown in FIG. 10.
Figure 15A:
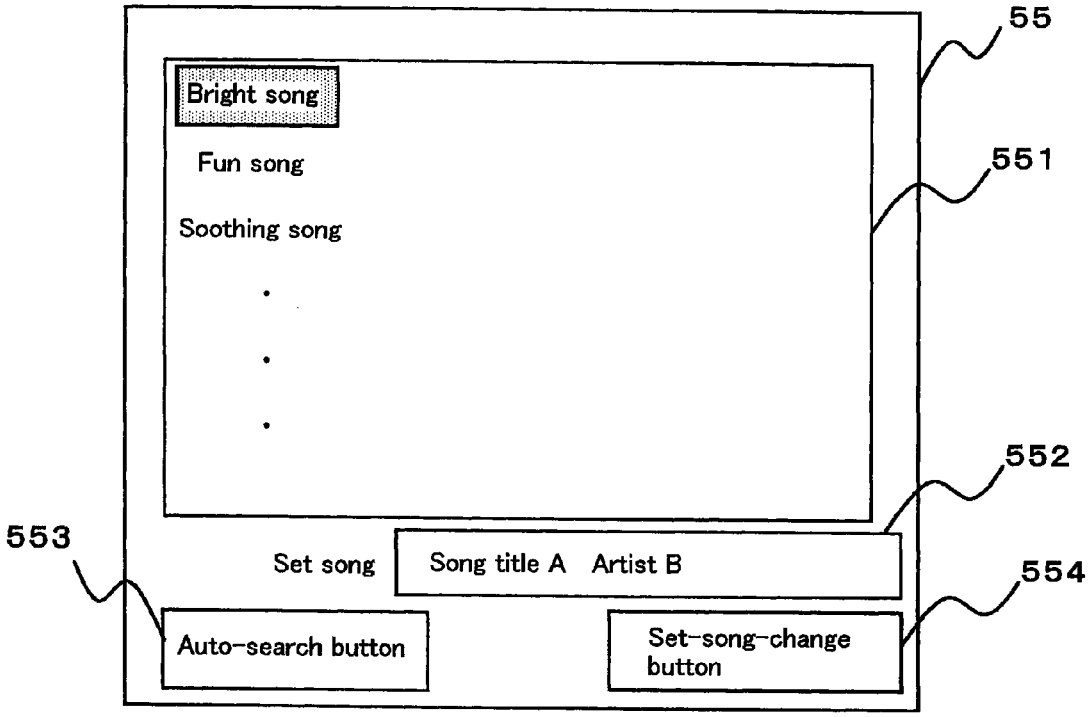
FIGS. 15A and 15B are drawings showing an example of the keyword-search-area displayed on the display screen shown in FIG. 10.
Figure 15B:
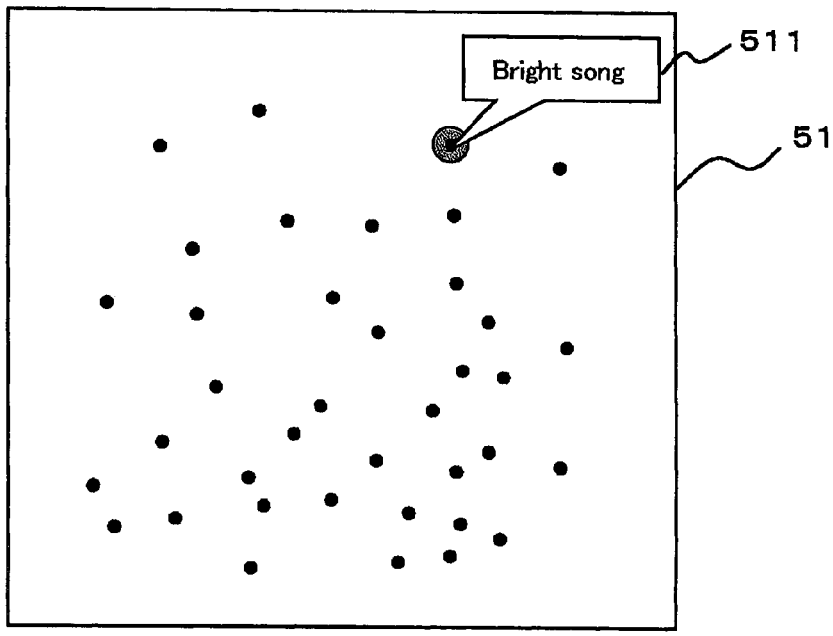

FIG. 3 is a flowchart for explaining the song-registration operation by the song search apparatus shown in FIG. 1; FIG. 4 is a flowchart for explaining the characteristic-data-extraction operation by the characteristic-data-extraction unit shown in FIG. 1; FIG. 5 is a flowchart for explaining the learning operation for learning a hierarchical-type neural network by the neural-network-learning apparatus shown in FIG. 2; FIG. 6 is a flowchart for explaining the learning operation for learning a song map by the neural-network-learning apparatus shown in FIG. 2; FIG. 7 is a flowchart for explaining the song search operation by the song search apparatus shown in FIG. 1; FIG. 8 is a drawing for explaining the learning algorithm for learning a hierarchical-type neural network by the neural-network-learning apparatus shown in FIG. 2; FIG. 9 is a drawing for explaining the learning algorithm for learning a song map by the neural-network-learning apparatus shown in FIG. 2; FIG. 10 is a drawing showing an example of the display screen of the PC-display unit shown in FIG. 1; FIG. 11 is a drawing showing an example of the display of the search-conditions-input area shown in FIG. 10; FIG. 12 and FIG. 13 are drawings showing examples of the display of the search-results-display area shown in FIG. 10; FIG. 14 is a drawing showing an example of the entire-song-list-display area that is displayed in the example of the display screen shown in FIG. 10; and FIGS. 15A and 15B are drawings showing an example of the keyword-search-area displayed on the display screen shown in FIG. 10.

First, FIG. 3 will be used to explain in detail the song-registration operation by the song search apparatus 10.

A memory medium such as a CD, DVD or the like on which song-data is recorded is set in the song-data-input unit 11, and the song data is input from the song-data-input unit 11 (step A1).

The compression-processing unit 12 compresses song data that is input from the song-data-input unit 11 (step A2), and stores the compressed song data in the song database 15 together with bibliographic data such as the artist name, song title, etc. (step A3).

The characteristic-data-extraction unit 13 extracts characteristic data that contains changing information from song data input from the song-data-input unit 11 (step A4).

As shown in FIG. 4, the extraction operation for extracting characteristic data by the characteristic-data-extraction unit 13 receives input of song data (step B1), and performs FFT (Fast Fourier Transform) on a set frame length from a preset starting point for data analysis of the song data (step B2), then calculates the power spectrum. Before performing step B2, it is also possible to perform down-sampling in order to improve speed.

Next, the characteristic-data-extraction unit 13 presets Low, Middle and High frequency bands, and integrates the power spectrum for the three bands, Low, Middle and High, to calculate the average power (step B3), and of the Low, Middle and High frequency bands, uses the band having the maximum power as the starting point for data analysis of the pitch, and measures the pitch (step B4).

The processing operation of step B2 to step B4 is performed for a preset number of frames, and the characteristic-data-extraction unit 13 determines whether or not the number of frames for which the processing operation of step B2 to step B4 has been performed has reached a preset setting (step B5), and when the number of frames for which the processing operation of step B2 to step B4 has been performed has not yet reached the preset setting, it shifts the starting point for data analysis (step B6), and repeats the processing operation of step B2 to step B4.

When the number of frames for which the processing operation of step B2 to step B4 has been performed has reached the preset setting, the characteristic-data-extraction unit 13 performs FFT on the timeline serious data of the average power of the Low, Middle and High bands calculated by the processing operation of step B2 to step B4, and performs FFT on the timeline serious data of the Pitch measured by the processing operation of step B2 to step B4 (step B7).

Next, from the FFT analysis results for the Low, Middle and High frequency bands, and the Pitch, the characteristic-data-extraction unit 13 calculates the slopes of the regression lines in a graph with the logarithmic frequency along the horizontal axis and the logarithmic power spectrum along the vertical axis, and the y-intercept of that regression line as the changing information (step B8), and outputs the slopes and y-intercepts of the regression lines for each of the respective Low, Middle and High frequency bands as eight items of characteristic data to the impression-data-conversion unit 14.

The impression-data-conversion unit 14 uses a hierarchical-type neural network having an input layer (first layer), intermediate layers (nth layers) and an output layer (Nth layer) shown in FIG. 8, and by inputting the characteristic data extracted by the characteristic-data-extraction unit 13 into the input layer (first layer), it outputs the impression data from the output layer (Nth layer), or in other words, converts the characteristic data to impression data (step A5), and together with outputting the impression data output from the output layer (Nth layer) to the song-mapping unit 16, it stores the impression data in the song database 15 together with the song data. The bond-weighting values w of each of the neurons in the intermediate layers (nth layers) are pre-learned by the neural-network-learning apparatus 40. Also, in the case of this embodiment, there are eight items, as described above, of characteristic data that are input into the input layer (first layer), or in other words, characteristic data that are extracted by the characteristic-data-extraction unit 13, and they are determined according to human emotion as the following eight items of impression data: (bright, dark), (heavy, light), (hard, soft), (stable, unstable), (clear, unclear), (smooth, crisp), (intense, mild) and (thick, thin), and each item is set so that it is expressed by 7-level evaluation. Therefore, there are eight neurons $L_1$ in the input layer (first layer) and eight neurons $L_N$ in the output layer (Nth layer), and the number of neurons Ln in the intermediate layers (nth layers: n=2, . . . , N−1) is set appropriately.

The song-mapping unit 16 maps the songs input from the song-data-input unit 11 on locations of the song map stored in the song-map-memory unit 17. The song map used in the mapping operation by the song-mapping unit 16 is a self-organized map (SOM) in which the neurons are arranged systematically in two dimensions (in the example shown in FIG. 9, it is 9×9 square), and is a learned neural network that does not require a teaching signal, and is a neural network in which the capability to classify an input pattern groups according to the degree of similarity is acquired autonomously. In this embodiment, a 2-dimensional SOM is used in which the neurons are arranged in a 100×100 square shape, however, the neuron arrangement can square shaped or can also be honeycomb shaped.

Also, the song map that is used in the mapping operation by the song-mapping unit 16 is learned by the neural-network-learning apparatus 40, and the pre-learned nth dimension characteristic vectors $m_i(t) \in R^n$ are included in the each neurons, and the song-mapping unit 16 uses the impression data converted by the impression-data-conversion unit 14 as input vectors $x_j$, and maps the input song onto the neurons closest to the input vectors $x_j$, or in other words, neurons that minimize the Euclidean distance $\|x_j - m_i\|$ (step A6), then stores the mapped song map in the song-map-memory unit 17. Here, R indicates the number of evaluation levels for each item of impression data, and n indicates the number of items of impression data.

Next, FIG. 5 and FIG. 8 will be used to explain in detail the learning operation of the hierarchical-type neural network that is used in the conversion operation (step A5) by the impression-data-conversion unit 14.

A memory medium such as a CD, DVD or the like on which song data is stored is set in the song-data-input unit 41, and input song data from the song-data-input unit 41 (step C1), and the characteristic-data-extraction unit 43 extracts characteristic data containing changing information from the song data input from the song-data-input unit 41 (step C2).

Also, the audio-output unit 42 outputs the song data input from the song-data-input unit 41 as audio output (step C3), and then by listening to the audio output from the audio-output unit 42, the evaluator evaluates the impression of the song according to emotion, and inputs the evaluation results from the impression-data-input unit 44 as impression data (step C4), then the bond-weighting-learning unit 45 receives the impression data input from the impression-data-input unit 44 as a teaching signal. In this embodiment, the eight items (bright, dark), (heavy, light), (hard, soft), (hard, soft), (stable, unstable), (clear, unclear), (smooth, crisp), (intense, mild), (thick, thin) are determined according to human emotion as evaluation items for the impression, and seven levels of evaluation for each evaluation item are received by the song-data-input unit 41 as impression data.

Learning of the hierarchical-type neural network by the bond-weighting-learning unit 45, or in other words, updating the bond-weighting values w for each neuron, is performed using an error back-propagation learning method.

First, as initial values, the bond-weighting values w for all of the neurons in the intermediate layers (nth layers) are set randomly to small values in the range −0.1 to 0.1, and the bond-weighting-learning unit 45 inputs the characteristic data extracted by the characteristic-data-extraction unit 43 into the input layer (first layer) as the input signals $x_j$ (j=1, 2, . . . , 8), then the output for each neuron is calculated going from the input layer (first layer) toward the output layer (Nth layer).

Next, the bond-weighting-learning unit 45 uses the impression data input from the impression-data-input unit 44 as teaching signals $y_j$ (j=1, 2, . . . , 8) to calculate the learning rule $\delta_j^N$ from the error between the output $out_j^N$ from the output layer (Nth layer) and the teacher signals $y_j$ using the following equation 1.

$$\delta_j^N = -(y_j - out_j^N)out_j^N(1 - out_j^N) \quad \text{[Equation 1]}$$

Next, the bond-weighting-learning unit 45 uses the learning rule $\delta_j^N$, and calculates the error signals $\delta_j^n$ from the intermediate layers (nth layers) using the following equation 2.

$$\delta_j^n = \left\{\sum_{k=1}^{L_{n+1}} \delta_j^{n+1} w_{k,j}^{n+1,n}\right\} out_j^n(1 - out_j^n) \quad \text{[Equation 2]}$$

In equation 2, w represents the bond-weighting value between the $j^{th}$ neuron in the $n^{th}$ layer and the $k^{th}$ neuron in the $n-1^{th}$ layer.

Next, the bond-weighting-learning unit 45 uses the error signals $\delta_j^n$ from the intermediate layers (nth layers) to calculate the amount of change Δw in the bond-weighting values w for each neuron using the following equation 3, and updates the bond-weighting values w for each neuron (step C5).

$$\Delta w_{ji}^{n-1} = -\eta \delta_j^n out_j^{n-1} \quad \text{[Equation 3]}$$

In equation 3, η represents the learning rate, and it is set to (0<η≦1).

The setting value T for setting the number of times learning is performed is set in advance, and the number of times learning is performed is t=0, 1, . . . , T, then the bond-weighting-learning unit 45 determines whether or not the number of times learning has been performed t has reached the setting value T (step C6), and the operation process of step C1 to step C5 is repeated until the number of times learning has been performed t has reached the setting value T, and when the number of times learning has been performed t has reached the setting value T, the learned bond-weighting values w for each neuron are output by way of the bond-weighting-output unit 47 (step C7). The bond-weighting values w output for each neuron are stored in the impression-data-conversion unit 14 of the song search apparatus 10.

The setting value T for setting the number of times learning is performed, should be set to a value such that the squared error E given by the following equation 4 is enough small.

$$E = \frac{1}{2}\sum_{j}^{L_N} (y_j - out_j^N) \quad \text{[Equation 4]}$$

Next, FIG. 6 and FIG. 9 will be used to explain in detail the learning operation for learning the song map used in the mapping operation (step A6) by the song-mapping unit 16.

A memory medium such as a CD, DVD or the like on which song data is stored is set into the song-data-input unit 41, and song data is input from the song-data-input unit 41 (step D1), then the audio-output unit 42 outputs the song data input from the song-data-input unit 41 as audio output (step D2), and by listening to the audio output from the audio-output unit 42, the evaluator evaluates the impression of the song according to emotion, and inputs the evaluation result as impression data from the impression-data-input unit 44 (step D3), and the song-map-learning unit 46 receives the impression data input from the impression-data-input unit 44 as input vectors for the self-organized map. In this embodiment, the eight items 'bright, dark', 'heavy, light', 'hard, soft', 'stable, unstable', 'clear, unclear', 'smooth, crisp', 'intense, mild', and 'thick, thin' that are determined according to human emotion are set as the evaluation items for the impression, and seven levels of evaluation for each evaluation item are received by the song-data-input unit 41 as impression data.

The song-map-learning unit 46 uses the impression data input from the impression-data-input unit 44 as input vectors $x_j(t) \in R^n$, and learns the characteristic vectors $m_i(t) \in R^n$ for each of the neurons. Here, t indicates the number of times learning has been performed, and the setting value T for setting the number of times to perform learning is set in advance, and learning is performed the number of times t=0, 1, . . . , T. Here, R indicates the evaluation levels of each evaluation items, and n indicates the number of items of impression data.

First, as initial values, characteristic vectors $m_c(0)$ for all of the neurons are set randomly in the range 0 to 1, and the song-map-learning unit 46 finds the winner neuron c that is closest to $x_j(t)$, or in other words, the winner neuron c that minimizes $\|x_j(t)-m_c(t)\|$, and updates the characteristic vector $m_c(t)$ of the winner neuron c, and the respective characteristic vectors $m_i(t)(i \in N_c)$ for the set $N_c$ of proximity neurons i near the winner neuron c according to the following equation 5 (step D4). The proximity radius for determining the proximity neurons i is set in advance.

$$m_i(t+1)=m_i(t)+h_{ci}(t)[x_j(t)-m_i(t)] \quad \text{[Equation 5]}$$

In equation 5, $h_{ci}(t)$ expresses the learning rate and is found from the following equation 6.

$$h_{ci}(t) = \alpha_{init}\left(1 - \frac{t}{T}\right)\exp\left(-\frac{\|m_c - m_i\|}{2R^2(t)}\right) \quad \text{[Equation 6]}$$

Here, a $\alpha_{init}$ is the initial value for the learning rate, and $R^2(t)$ is a uniformly decreasing linear function or an exponential function.

Next, the song-map-learning unit 46 determines whether or not the number of times learning has been performed t has reached the setting value T (step D5), and it repeats the processing operation of step D1 to step D4 until the number of times learning has been performed t has reached the setting value T, and when the number of times learning has been performed t reaches the setting value T, the learned characteristic vectors $m_i(T) \in R^n$ are output by way of the characteristic-vector-output unit 48 (step D6). The output characteristic vectors $m_i(T)$ for each of the neurons i are stored in the song-map-memory unit 17 of the song search apparatus 10 as a song map.

Next, FIG. 7 will be used to explain in detail the song search operation by the song search apparatus 10.

The song search unit 18 displays a search screen 50 as shown in FIG. 10 on the PC-display unit 20, and receives user input from the PC-control unit 19. The search screen 50 comprises: a song-map-display area 51 in which the mapping status of the song map stored in the song-map-memory unit 17 are displayed; a search-conditions-input area 52 in which search conditions are input; and a search-results-display area 53 in which search results are displayed. The dots displayed in the song-map-display area 51 shown in FIG. 10 indicate the neurons of the song map on which song data are mapped.

As shown in FIG. 11, the search-conditions-input area 52 comprises: an impression-data-input area 521 in which impression data is input as search conditions; a bibliographic-data-input area 522 in which bibliographic data is input as search conditions; and a search-execution button 523 that gives an instruction to execute a search when the user inputs impression data and bibliographic data as search conditions from the PC-control unit 19 (step E1), and then clicks on the search-execution button 523, an instruction is given to the song search unit 18 to perform a search based on the impression data and bibliographic data. As shown in FIG. 11, input of impression data from the PC-control unit 19 is performed by inputting the items of impression data using 7-steps evaluation.

The song search unit 18 searches the song database 15 based on impression data and bibliographic data input from the PC-control unit 19 (step E2), and displays search results as shown in FIG. 12 in the search-results-display area 53.

Searching based on the impression data input from the PC-control unit 19 uses the impression data input from the PC-control unit 19 as input vectors $x_j$, and uses the impression data stored with the song data in the song database 15 as target search vectors $X_j$, and performs the search in order of target search vectors $X_j$ that are the closest to the input vectors $x_j$, or in other words, in the order of smallest Euclidean distance $\|x_j-m_i\|$. The number of items searched can be preset or can be set arbitrarily by the user. Also, when both impression data and bibliographic data are used as search conditions, searching based on the impression data is performed after performing a search based on the bibliographic data. Here, R indicates the number of evaluation levels of each item of impression data, and n indicates the number of items of impression data.

Other than performing a search using the search-conditions-input area 52, it is also possible to perform a search using the song-map-display area 51. In this case, by specifying a target-search area in the song-map-display area 51, the song data mapped in the target-search area is displayed in the search-results-display area 53 as the search results.

Next, the user selects a representative song from among the search results displayed in the search-results-display area 53 (step E3), and by clicking on the representative-search-execution button 531, an instruction is given to the song search unit 18 to perform a search based on the representative song.

The song search unit 18 searches the song map stored in the song-map-memory unit 17 based on the selected representative song (step E4), and displays the song data mapped on the neurons for which the representative song is mapped and on the proximity neurons in the search-results-display area 53 as representative-search results. The proximity radius for determining the proximity neurons can be preset or can be set arbitrarily by the user.

Next, as shown in FIG. 13, the user selects song data from among the representative-song search results displayed in the search-results-display area 53 to output to the terminal apparatus 30 (step E5), and by clicking on the output button 532, gives an instruction to the song search unit 18 to output the selected song data, and then the song search unit 18 outputs the song data that was selected by the user by way of the search-results-output unit 21 to the terminal apparatus 30 (step E6).

Besides performing a representative song search using the search-conditions-input area 52 and song-map-display area 51, it is also possible to display an entire-song-list-display area 54 as shown in FIG. 14 in which a list of all of the stored songs is displayed on the search screen 50, and to directly select a representative song from the entire song list, and then by clicking on the representative-song-selection-execution button 541, give an instruction to the song search unit 18 to perform a search based on the selected representative song.

Furthermore, other than performing a search as described above, it is also possible to set neurons (or songs) that correspond to keywords expressed in words such as 'bright song', 'fun song' or 'soothing song', and then search for songs by selecting the keywords. In other words, by displaying a keyword-search area 55 as shown in FIG. 15A on the search screen 50 and then selecting some keywords from a list of keywords displayed in a keyword-selection area 551 and by clicking on an auto-search button 553, an instruction is given to the song search unit 18 to perform a search based on the neurons corresponding to the selected keywords. When a song corresponding to the selected keywords is set in a set-song-display area 552 as shown in FIG. 1SA, the song is displayed as a set song, and in this case, by clicking on the auto-search button 553, an instruction is given to the song search unit 18 to perform a search using the set song corresponding to the selected keywords as a representative song. The set-song-change button 554 shown in FIG. 15A is used to change the song corresponding to the keywords, so by clicking on the set-song-change button 554, the entire-song list is displayed, and by selecting a song from among the entire-song list, it is possible to change the song corresponding to the keywords. The neurons (or songs) corresponding to the keywords can be set by assigning impression data to a keyword, and using that impression data as input vectors $x_j$ and correlating it with the neurons (or songs) that are the closest to the input vectors $x_j$, or can be set arbitrarily by the user.

When neurons corresponding with keywords are set in this way, then as shown in FIG. 15B, by clicking on a neuron in the song-map-display area 51 for which songs are mapped, the keyword that corresponds to the neuron that was clicked on is displayed as a popup keyword display 511, and thus it is possible to easily perform a song search by using the song-map-display area 51.

As explained above, with this embodiment, the impression-data-conversion unit 14 uses a hierarchical-type neural network that directly correlates characteristic data comprising a plurality of physical items of songs, with impression data comprising items determined according to human emotion, to convert characteristic data extracted from the song data to impression data, and by storing the converted impression data in the song database 15 and performing a search of the impression data stored in the song database 15 by the song search unit 18 based on impression data input by the user, it is possible to search the song data with high precision based on the impression data determined according to human emotion without concentrating on items of impression data determined according to human emotion input as search conditions by the user, and thus it is possible to effectively search for just songs that have the same impression as a song listened to from among a large-quantity of song data stored in a large-capacity memory means.

Also, this embodiment is constructed such that the song map is a pre-learned self-organized map on which song data is mapped based on impression data that has the song data, and that song map is stored in the song-map-memory unit 17, and by having the song search unit 18 search using the song map stored in the song-map-memory unit 17, it is effective in making it possible to quickly find songs having the same impression of a representative song from among a large quantity of song data stored in a large-capacity memory means.

Moreover, this embodiment is constructed such that a hierarchical-type neural network used by the impression-data-conversion unit 14 is learned using the impression data that was input by an evaluator that listened to song data as a teaching signal, for example, the user's trust can be improved by employing prominent persons recognized by the user as an evaluator, and by preparing hierarchical-type neural networks for which learning is respectively performed by a plurality of evaluators that can be selected by the user, it is effective in improving convenience for the user.

Furthermore, this embodiment is constructed such that a characteristic-data-extraction unit 13 extracts a plurality of items containing changing information as characteristic data, and is capable of accurately extracting physical characteristics of song data, and thus it is effective in making it possible to improve the accuracy of the impression data converted from characteristic data.

Also, with this embodiment, it is possible to set various items, using the same number of a plurality of items of impression data converted from characteristic data by the impression-data-conversion unit 14 and impression data input from the PC-control unit 19, so it is effective in making it possible for the user to easily perform a search based on the impression data.

Moreover, this embodiment is constructed such that a song search unit 18 uses impression data input from the PC control unit 19 as input vectors and impression data stored in the song-data database 15 as target search vectors, and performs a search in order of the smallest Euclidean distance of the both, and thus is effective in making it possible to perform an accurate search even when there are many items of impression data, and improve the search precision.

Furthermore, with this embodiment, by using a pre-learned self-organized map as the song map, songs having similar impression are arranged next to each other, so it is effective in improving the search efficiency.

Figure 16:
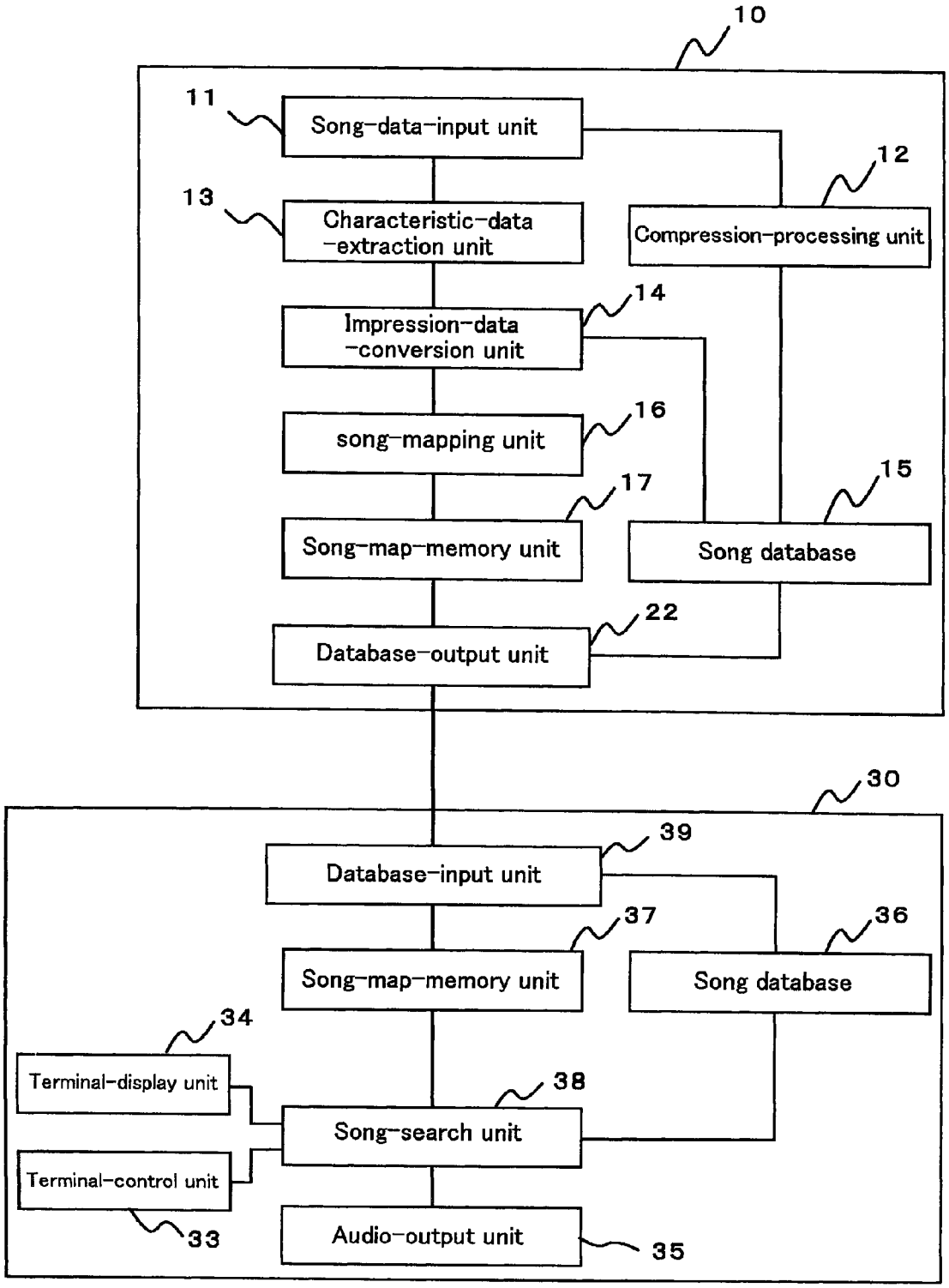
FIG. 16 is a block diagram showing the construction of another embodiment of the song search system of the present invention.

Next, FIG. 16 will be used to explain in detail another embodiment of the present invention.

FIG. 16 is a block diagram showing the construction of another embodiment of the song search system of the present invention.

The embodiment shown in FIG. 16 is constructed such that a terminal unit 30 comprises a song database 36, song-map-memory unit 37 and song search unit 38 that have the same function as the song database 15, song-map-memory unit 17 and song search unit 18 shown in FIG. 1, and by using the terminal apparatus 30, it can perform searches of the song database 36 and searches of the song map stored in the song-map-memory unit 37. In the other embodiment, the song search apparatus 10 functions as a song-registration apparatus that stores respectively song data input from the song-data-input unit 11 in the song database 15; impression data converted by the impression-data-conversion unit 14 in the song database 15; and song map mapped by the song-mapping unit 16 in the song-map-memory unit 17.

The database-output unit 22 outputs the song database 15 of the song search apparatus 10 and the memory contents of the song-map-memory unit 17 to the terminal apparatus 30. And the database-input unit 39 of the terminal apparatus 30 stores the song database 15 and the memory contents of the song-map-memory unit 17 in the song database 36 and song-map-memory unit 37. The search conditions are input from the terminal-control unit 33 based on the display contents of the terminal-display unit 34.

The present invention is not limited by the embodiments described above, and it is clear that the embodiments can be suitably changed within the technical scope of the present invention. Also, the number, location, shape, etc. of the component parts above is not limited by the embodiments described above, and any suitable number, location, shape, etc. is possible in applying the present invention. In the drawings, the same reference numbers are used for identical components elements.

The song search system and song search method of this invention uses a hierarchical-type neural network to directly correlate characteristic data containing a plurality of physical items of songs, with impression data containing items determined according to human emotion, and by converting the characteristic data extracted from the song data to impression data and storing it, it is possible to search the stored impression data based on the impression data input by the user, so it is possible to search the song data with high precision based on the impression data determined according to human emotion without concentrating on items determined according to human emotion input as search conditions by the user, and thus it is possible to effectively search for just songs that have the same impression as a song listened to from among a large-quantity of song data stored in a large-capacity memory means.

Moreover, the song search system and song search method of the present invention are constructed such that a hierarchical-type neural network used in converting song data to impression data is learned using the impression data that was input by an evaluator that listened to the song data as a teaching signal; for example, the user's trust can be improved by employing prominent persons recognized by the user as evaluators, and by preparing hierarchical-type neural networks for which learning is performed by a plurality of evaluators that can be selected by the user, it is effective in improving convenience for the user.

Furthermore, the song search system and song search method of the present invention are constructed such that a plurality of items containing changing information are extracted as characteristic data, and it is possible to accurately extract physical characteristics of song data, so it is effective in making it possible to improve the accuracy of the impression data converted from characteristic data.

Also, the song search system and song search method of the present invention are capable of setting various items using the same number of a plurality of items of impression data converted from characteristic data and impression data input by the user, so it is effective in making it possible for the user to easily perform a search based on impression data.

Moreover, the song search system and song search method of the present invention use impression data input by the user as input vectors and use impression data stored in song-data database as target search vectors, to perform a search in order of the smallest Euclidean distance of both, and thus is effective in making it possible to perform an accurate search even when there are many items of impression data, and improve the search precision.

Also, the song search system and song search method of the present invention are constructed such that the song map is a pre-learned self-organized map on which song data is mapped based on impression data of the song data, and by simply selecting a representative song, can quickly find songs from among a large quantity of song data stored in a large-capacity memory means that have the same impression.

Furthermore, the song search system and song search method of the present invention use a pre-learned self-organized map as the song map, and since songs having similar impression are arranged next to each other, it is effective in improving the search efficiency.

What is claimed is:

1. A song search system that searches for desired song data from among a plurality of song data stored in a song database, the song search system comprising:

a song-data-input means of inputting said song data;

a characteristic-data-extraction means of extracting physical characteristic data by performing a Fast Fourier Transform on a set frame length and by calculating the power spectrum from song data input by said song-data-input means;

an impression-data-conversion means of converting the physical characteristic data extracted by said characteristic-data-extraction means into impression data determined by human emotion;

a memory-control means of storing impression data converted by said impression-data-conversion means in a song database together with song data input by said song-data-input means;

a keyword set means of setting song data to correspond to one or more keywords;

a song-mapping-display means of displaying a song map comprised of neurons each representing song data;

a keyword-display means of displaying the one or more keywords corresponding to particular song data when the neuron representing the particular song data displayed on said song-mapping-display means is clicked on;

an impression-data-input means of inputting impression data as search conditions;

a song search means of searching said song database based on impression data input from said impression-data-input means and the one or more keywords; and a song-data-output means of outputting song data found by said song search means, wherein said impression-data-conversion means uses a pre-learned hierarchical-type neural network to convert characteristic data extracted by said characteristic-data-extraction means to impression data determined according to human emotion.

2. The song search system as claimed in claim 1, wherein said hierarchical-type neural network is learned using impression data input by an evaluator that listened to song data as a teaching signal.

3. The song search system as claimed in any one of claims 1 and 2, wherein said characteristic-data-extraction means extracts a plurality of items containing changing information as characteristic data.

4. The song search system as claimed in any one of claims 1 and 2, wherein said impression data converted by said impression-data-conversion means and impression data input from said impression-data-input means contain the same number of a plurality of items.

5. The song search system as claimed in claim 4, wherein said song search means uses impression data input from said impression-data-input means as input vectors, and uses impression data stored in said song database as target search vectors, to perform a search in order of the smallest Euclidean distance of both.

6. A song search system comprising:

a song search apparatus that searches desired song data from among a plurality of song data stored in a song database; and a terminal apparatus that can be connected to the song search apparatus;

wherein said song search apparatus further comprises:

a song-data-input means of inputting said song data;

a characteristic-data-extraction means of extracting physical characteristic data by performing a Fast Fourier Transform on a set frame length and by calculating the power spectrum from song data input by said song-data-input means;

an impression-data-conversion means of converting the physical characteristic data extracted by said characteristic-data-extraction means into impression data determined according to human emotion;

a memory-control means of storing impression data converted by said impression-data-conversion means in a song database together with song data input by said song-data-input means;

a keyword set means of setting song data to correspond to one or more keywords;

a song-mapping-display means of displaying a song map comprised of neurons each representing song data;

a keyword-display means of displaying the one or more keywords corresponding to particular song data when the neuron representing the particular song data displayed on said song-mapping-display means is clicked on;

an impression-data-input means of inputting impression data as search conditions;

a song search means of searching said song database based on impression data input from said impression-data-input means and the one or more keywords; and a song-data-output means of outputting song data found by said song search means to said terminal apparatus; and wherein said terminal apparatus further comprises:

a search-results-input means of inputting song data from said song search apparatus;

a search-results-memory means of storing song data input by said search-results-input means;

an audio-output means of reproducing song data stored in said search-results-memory means; and wherein said impression-data-conversion means uses a pre-learned hierarchical-type neural network to convert characteristic data extracted by said characteristic-data-extraction means to impression data determined according to human emotion.

7. The song search system as claimed in claim 6, wherein said hierarchical-type neural network is learned using impression data input by an evaluator that listened to song data as a teaching signal.

8. The song search system as claimed in any one of claims 6 and 7, wherein said characteristic-data-extraction means extracts a plurality of items containing changing information as characteristic data.

9. The song search system as claimed in any one of claims 6 and 7, wherein said impression data converted by said impression-data-conversion means and impression data input from said impression-data-input means contain the same number of a plurality of items.

10. The song search system as claimed in claim 9, wherein said song search means uses impression data input from said impression-data-input means as input vectors, and uses impression data stored in said song database as target search vectors, to perform a search in order of the smallest Euclidean distance of both.

11. A song search system comprising:

a song-registration apparatus that stores input song data in a song database; and a terminal apparatus that can be connected to said song-registration apparatus;

wherein said song-registration apparatus further comprises:

a song-data-input means of inputting said song data;

a characteristic-data-extraction means of extracting physical characteristic data by performing a Fast Fourier Transform on a set frame length and by calculating the power spectrum from song data input by said song-data-input means;

an impression-data-conversion means of converting the physical characteristic data extracted by said characteristic-data-extraction means into impression data determined according to human emotion;

a memory-control means of storing impression data converted by said impression-data-conversion means in a song database together with song data input by said song-data-input means;

a keyword set means of setting song data to correspond to one or more keywords;

a song-mapping-display means of displaying a song map comprised of neurons each representing song data;

a keyword-display means of displaying the one or more keywords corresponding to particular song data when the neuron representing the particular song data displayed on said song-mapping-display means is clicked on; and a database-output means of outputting song data and impression data stored in said song database to said terminal apparatus; and wherein said terminal apparatus further comprises:

a database-input means of inputting song data and impression data from said song-registration apparatus;

a terminal-side song database that stores song data and impression data input by said database-input means;

an impression-data-input means of inputting impression data as search conditions;

a song search means of searching said terminal-side song database based on impression data input from said impression-data-input means and the one or more keywords; and an audio-output means of reproducing song data found by said song search means; and wherein said impression-data-conversion means uses a pre-learned hierarchical-type neural network to convert characteristic data extracted by said characteristic-data-extraction means to impression data determined according to human emotion.

12. The song search system as claimed in claim 11, wherein said hierarchical-type neural network is learned using impression data input by an evaluator that listened to song data as a teaching signal.

13. The song search system as claimed in any one of claims 11 and 12, wherein said characteristic-data-extraction means extracts a plurality of items containing changing information as characteristic data.

14. The song search system as claimed in any one of claims 11 and 12, wherein said impression data converted by said impression-data-conversion means and impression data input from said impression-data-input means contain the same number of a plurality of items.

15. The song search system as claimed in claim 14, wherein said song search means uses impression data input from said impression-data-input means as input vectors, and uses impression data stored in said terminal-side song database as target search vectors, and performs a search in order of the smallest Euclidean distance of both.

16. A song search method of searching for desired song data from among a plurality of song data stored in a song database, the song search method comprising:

receiving input said song data;

extracting physical characteristic data by performing a Fast Fourier Transform on a set frame length and by calculating the power spectrum from said input song data;

converting said extracted physical characteristic data into impression data determined according to human emotion;

storing converted impression data in a song database together with said received song data;

receiving input impression data as search conditions;

setting song data to correspond to one or more keywords;

displaying a song map comprised of neurons each representing song data;

displaying the one or more keywords corresponding to particular song data when the neuron representing the particular song data displayed on said song-mapping-display means is clicked on;

searching said song database based on received impression data and the one or more keywords; and outputting found song data, wherein a pre-learned hierarchical-type neural network is used to convert said extracted characteristic data to impression data determined according to human emotion.

17. The song search method as claimed in claim 16, wherein said hierarchical-type neural network, which is pre-learned using impression data input by an evaluator that listened to song data as a teaching signal, is used to convert said extracted characteristic data to impression data determined according to human emotion.

18. The song search method as claimed in any one of claims 16 and 17, wherein a plurality of items containing changing information as characteristic data are extracted.

19. The song search method as claimed in any one of claims 16 and 17, wherein said converted impression data and said received impression data contain the same number of a plurality of items.

20. The song search method as claimed in claim 19, wherein said received impression data as input vectors, and impression data stored in said song database as target search vectors are used to perform a search in order of the smallest Euclidean distance of both.

21. A computer readable medium storing a song search program for causing a computer to execute the song search method as claimed in claim 16.

22. A song search system that searches for desired song data from among a plurality of song data stored in a song database, the song search system comprising:

a song-data-input means of inputting said song data;

a characteristic-data-extraction means of extracting physical characteristic data by performing a Fast Fourier Transform on a set frame length and by calculating the power spectrum from song data input by said song-data-input means;

an impression-data-conversion means of converting the physical characteristic data extracted by said characteristic-data-extraction means into impression data determined according to human emotion;

a song-mapping means that, based on impression data converted by said impression-data-conversion means, maps song data input by said song-data-input means onto a song map, which is a pre-learned self-organized map;

a song-map-memory means of storing song data that are mapped by said song-mapping means;

a representative-song-selection means of selecting a representative song from among song data mapped on a song map;

a song search means of searching a song map based on a representative song selected by said representative-song-selection means; and a song-data-output means of outputting song data found by said song search means, wherein said impression-data-conversion means uses a pre-learned hierarchical-type neural network to convert characteristic data extracted by said characteristic-data-extraction means to impression data determined according to human emotion.

23. A song search system comprising:

a song search apparatus that searches for desired song data from among a plurality of song data stored in a song database; and a terminal apparatus that can be connected to the song search apparatus; wherein said song search apparatus further comprises:

a song-data-input means of inputting said song data;

a characteristic-data-extraction means of extracting physical characteristic data by performing a Fast Fourier Transform on a set frame length and by calculating the power spectrum from song data input by said song-data-input means;

an impression-data-conversion means of converting the physical characteristic data extracted by said characteristic-data-extraction means into impression data determined according to human emotion;

a song-mapping means that, based on impression data converted by said impression-data-conversion means, maps song data input by said song-data-input means onto a song map, which is a pre-learned self-organized map;

a song-map-memory means of storing song data that are mapped by said song-mapping means;

a representative-song-selection means of selecting a representative song from among song data mapped on a song map;

a song search means of searching a song map based on a representative song selected by said representative-song-selection means; and a song-data-output means of outputting song data found by said song search means; and wherein said terminal apparatus further comprises:

a search-results-input means of inputting song data from said song search apparatus;

a search-results-memory means of storing song data input by said search-results-input means; and an audio-output means of reproducing song data stored in said search-results-memory means; and wherein said impression-data-conversion means uses a pre-learned hierarchical-type neural network to convert characteristic data extracted by said characteristic-data-extraction means to impression data determined according to human emotion.

24. A song search system comprising:

a song-registration apparatus that stores input song data in a song database; and a terminal apparatus that can be connected to said song-registration apparatus;

wherein said song-registration apparatus further comprises:

a song-data-input means of inputting said song data;

a characteristic-data-extraction means of extracting physical characteristic data by performing a Fast Fourier Transform on a set frame length and by calculating the power spectrum from song data input by said song-data-input means;

an impression-data-conversion means of converting the physical characteristic data extracted by said characteristic-data-extraction means into impression data determined according to human emotion;

a song-mapping means that, based on impression data converted by said impression-data-conversion means, maps song data input by said song-data-input means onto a song map, which is a pre-learned self-organized map;

a song-map-memory means of storing song data that are mapped by said song-mapping means; and a database-output means of outputting song data stored in said song database, and song map stored in said song-map-memory means in said terminal apparatus; and wherein said terminal apparatus further comprises:

a database-input means of inputting song data and song map from said song-registration apparatus;

a terminal-side song database that stores song data input by said database-input means;

a terminal-side song-map-memory means of storing a song map input by said database-input means;

a representative-song-selection means of selecting a representative song from among song data mapped on a song map;

a song search means of searching a song map based on a representative song selected by said representative-song-selection means; and an audio-output means of reproducing song data found by said song search means;

wherein said impression-data-conversion means uses a pre-learned hierarchical-type neural network to convert characteristic data extracted by said characteristic-data-extraction means to impression data determined according to human emotion.

25. The song search system as claimed in any one of claims 22 to 24, wherein said hierarchical-type neural network is learned using impression data input by an evaluator that listened to song data, as a teaching signal.

26. The song search system as claimed in any one of claims 22 to 24, wherein said characteristic-data-extraction means extracts a plurality of items containing changing information as characteristic data.

27. The song search system as claimed in any one of claims 22 to 24, wherein said song-mapping means uses impression data converted by said impression-data-conversion means as input vectors to map song data input by said song-data-input means onto neurons closest to said input vectors.

28. The song search system as claimed in any one of claims 22 to 24, wherein said song search means searches for song data contained in neurons for which a representative song is mapped.

29. The song search system as claimed in any one of claims 22 to 24, wherein said song search means searches for song data contained in neurons for which a representative song is mapped, and contained in proximity neurons based on proximity radius.

30. The song search system as claimed in any one of claims 22 to 24 wherein the proximity radius for determining proximity neurons by said song search means can be set arbitrarily.

31. The song search system as claimed in any one of claims 22 to 24, wherein learning is performed using impression data input by an evaluator that listened to the song data.

32. A song search system that searches for desired song data from among a plurality of song data stored in a song database, the song search system comprising:

a song map that is a pre-learned self-organized map on which song data are mapped wherein the song map is created by a converter for converting the song data into the song map based on extracted physical characteristics by performing a Fast Fourier Transform on a set frame length and by calculating the power spectrum of the song data;

a representative-song-selection means of selecting a representative song from among song data mapped on a song map;

a song search means of searching a song map based on a representative song selected by said representative-song-selection means; and a song-data-output means of outputting song data found by said song search means, wherein a song data is mapped on a song map using impression data that contains the song data as input vectors and the converter uses a pre-learned hierarchical-type neural network to convert the extracted physical characteristics of the song to the impression data determined according to human emotion.

33. The song search system as claimed in claim 32, wherein said song search means searches for song data contained in neurons for which a representative song is mapped.

34. The song search system as claimed in claim 32, wherein said song search means searches for song data contained in neurons for which a representative song is mapped and contained in proximity neurons based on proximity radius.

35. The song search system as claimed in claim 32, wherein the proximity radius for setting the proximity neurons by said song search means can be set arbitrarily.

36. The song search system as claimed in claim 32, wherein the song map performed a learning using impression data input by an evaluator that listened to song data.

37. A song search method of searching for desired song data from among a plurality of song data stored in a song database; the song search method comprising:

receiving input said song data;

extracting physical characteristic data by performing a Fast Fourier Transform on a set frame length and by calculating the power spectrum from said input song data;

converting said extracted physical characteristic data into impression data determined according to human emotion;

mapping said received song data onto a song map, which is a pre-learned self-organized map, based on said converted impression data;

selecting a representative song from among song data mapped on a song map;

searching for song data mapped on song map based on said selected representative song; and outputting found song data, wherein a pre-learned hierarchical-type neural network is used to convert said extracted characteristic data to impression data determined according to human emotion.

38. The song search method as claimed in claim 37, wherein said hierarchical-type neural network, which was pre-learned using impression data input by an evaluator that listened to song data as a teaching signal, is used to convert said extracted characteristic data to impression data determined according to human emotion.

39. The song search method as claimed in any one of claims 37 and 38, wherein a plurality of items containing changing information as characteristic data are extracted.

40. The song search method as claimed in any one of claims 37 and 38, wherein said converted impression data as input vectors is used to map said input song data on neurons nearest to said input vectors.

41. The song search method as claimed in any one of claims 37 and 38, wherein song data contained in neurons for which a representative song is mapped is searched for.

42. The song search method as claimed in any one of claims 37 and 38, wherein song data contained in neurons for which a representative song is mapped, and contained in proximity neurons based on proximity radius is searched for.

43. The song search method as claimed in any one of claims 37 and 38, wherein the proximity radius for determining proximity neurons can be set arbitrarily.

44. The song search method as claimed in any one of claims 37 and 38, wherein the song map performed a learning using impression data input by an evaluator which listened to song data.

45. A song search method of searching for desired song data from among a plurality of song data stored in a song database, the song search method comprising:

selecting a representative song from among song data mapped on a song map that is a pre-learned self-organized map on which song data are mapped wherein the song map is created by a converter for converting the song data into the song map based on extracted physical characteristics by performing a Fast Fourier Transform on a set frame length and by calculating the power spectrum of the song data;

searching for song data that are mapped on song map based on said selected representative song; and outputting said found song data, wherein a song data is mapped on a song map using impression data that contains the song data as input vectors and the converter uses a pre-learned hierarchical-type neural network to convert the extracted physical characteristics of the song to the impression data determined according to human emotion.

46. The song search method as claimed in claim 45, wherein song data contained in neurons for which a representative song is mapped is searched for.

47. The song search method as claimed in claim 45, wherein song data contained in neurons for which a representative song is mapped, and contained in proximity neurons based on proximity radius is searched for.

48. The song search method as claimed in claim 45, wherein the proximity radius for setting proximity neurons can be set arbitrarily.

49. The song search method as claimed in claim 45, wherein the song map performed a learning using impression data input by an evaluator that listened to song data.

50. A computer readable medium storing a song search program causing a computer to execute the song search method as claimed in any one of claims 37 and 38.

51. The song search system as claimed in claim 1, wherein the impression data conversion section includes a bond-weighted-learning unit to update weighting of the impression data in the song database.

52. The song search system as claimed in claim 1, wherein the physical characteristic data includes power spectrum and pitch of the song data.

* * * * *